US005799503A

United States Patent [19]

Koda et al.

[11] Patent Number: 5,799,503

[45] Date of Patent: Sep. 1, 1998

[54] ACCUMULATOR

[75] Inventors: Toshihide Koda; Mihoko Shimoji; Masahiro Sugihara; Naoki Tanaka; Hitoshi Iijima; Takeshi Izawa; Masaki Toyoshima, all of Tokyo, Japan

[73] Assignee: Mitsubishi Denki Kabushiki Kaisha, Tokyo, Japan

[21] Appl. No.: 831,525

[22] Filed: Apr. 1, 1997

[30] Foreign Application Priority Data

Apr. 26, 1996 [JP] Japan ..... 8-107359

[51] Int. Cl.[6] ..... F15B 1/02

[52] U.S. Cl. ..... 62/503; 62/471

[58] Field of Search ..... 62/503, 471, 470, 62/473, 468, 84, 83

[56] References Cited

U.S. PATENT DOCUMENTS

| | | | |
|---|---|---|---|
| 1,899,378 | 2/1933 | Zouck et al. . | |
| 2,770,105 | 11/1956 | Colton . | |
| 3,563,053 | 2/1971 | Bottum | 62/503 |
| 3,796,064 | 3/1974 | Ladusaw | 62/503 |
| 3,938,353 | 2/1976 | Wrenn, Jr. et al. | 62/503 |
| 4,757,696 | 7/1988 | Gannaway | 62/503 |
| 5,347,817 | 9/1994 | Kim | 62/471 |
| 5,531,080 | 7/1996 | Hirahara et al. | 62/470 |

FOREIGN PATENT DOCUMENTS

| | | |
|---|---|---|
| 08005204 | 1/1996 | Japan . |
| 622043 | 4/1949 | United Kingdom . |
| 725925 | 3/1955 | United Kingdom . |

*Primary Examiner*—Harry B. Tanner

*Attorney, Agent, or Firm*—Sughrue, Mion Zinn, Macpeak & Seas, PLLC

[57] ABSTRACT

In an accumulator, an oil collecting pipe is held in a sealed vessel with the lower end thereof closed, the pipe has a plurality of oil collecting apertures spaced in a vertical direction and a communication port for communicating with a discharge pipe. The communication port is disposed in the vicinity of the lowermost oil collecting aperture or to the downstream side of the aperture. Therefore, excessive liquid refrigerant flow from the accumulator is prevented even if a large amount of the liquid refrigerant resides in the sealed vessel.

15 Claims, 24 Drawing Sheets

ACCUMULATOR

BACKGROUND OF THE INVENTION

1. Field of the Invention

The present invention relates to an accumulator constituting part of a refrigerating/air conditioning circuit of an air conditioner, refrigerator and the like, in particular for those that use refrigeration machine oil which has little or no solubility in refrigerant or, which if soluble, has a characteristic for separating from refrigerant depending upon temperature conditions.

2. Description of the Related Art

An example of a conventional accumulator will now be described. FIG. 22 is a longitudinal cross sectional view showing the structure of the accumulator disclosed in Japanese Utility Model Publication No. 5-39409.

In the drawing, a vessel 101 is provided with a suction pipe 102 and a discharge pipe 103. Liquid refrigerant 104 and refrigeration machine oil 105 reside in the vessel 101. A plurality of oil collecting apertures 103*a*–103*e* are defined in the discharge pipe 103 in a vertical direction and five holes are defined in this example. The discharge pipe 103 is provided with a gas inlet 103*f*. Symbol U denotes the flow velocity in the discharge pipe 103.

In a refrigerating/air conditioning circuit to which the accumulator is assembled, a fluid containing refrigerant gas, the liquid refrigerant 104 and the refrigeration machine oil 105 flows into the vessel 101 through the suction pipe 102. The refrigerant gas is separated from the liquid refrigerant in the space in the vessel 101 and the refrigerant gas flows to the outside of the vessel 101 from the gas inlet 103*f* through the discharge pipe 103. On the other hand, the liquid refrigerant 104 and the refrigeration machine oil 105 stay in the bottom of the vessel 101.

When the refrigeration machine oil 105 is barely soluble or in soluble in the liquid refrigerant 104 are even when it tends to separate from the liquid refrigerant 104 under certain operating conditions. The refrigeration machine oil 105 in the vessel 101 then separates from the refrigerant 104 as shown in the drawing and the refrigeration machine oil 105 with a thickness h floats on the upper layer of the liquid refrigerant 104 having a liquid surface height H. Since the oil collecting apertures 103*a*–103*e* are disposed at a plurality of positions in a vertical direction, the refrigeration machine oil 105 and the liquid refrigerant 104 are sucked into the discharge pipe 103 through the oil collecting apertures 103*a*–103*e* and flow in a mixture with the refrigerant gas.

Next, another example of the conventional accumulator will be shown. FIG. 23 is a longitudinal cross sectional view showing the structure of the accumulator disclosed in Japanese Utility Model Laid-Open No. 58-87079 in which the inner arrangement of the accumulator is different from that of the above conventional example.

In the drawing, a vessel 106 is provided with a suction pipe 107 and a discharge pipe 108. A plurality of oil collecting apertures 108*a*–108*e* are defined in the discharge pipe 108 in a vertical direction. Liquid refrigerant 109 and refrigeration machine oil 110 reside in the vessel 106.

In a refrigerating/air conditioning circuit to which the accumulator is assembled, a fluid containing refrigerant gas, the liquid refrigerant 109 and the refrigeration machine oil 110 flows into the vessel 106 through the suction pipe 107. The refrigerant gas is separated from the liquid refrigerant in the space in the vessel 106 so that the refrigeration machine oil 110 is separated from the liquid refrigerant 109 and the refrigeration machine oil 110 having a smaller specific gravity floats on the upper layer of the liquid refrigerant 109. The oil collecting apertures 108*a*–108*e* are disposed at a plurality of positions in a vertical direction and the refrigeration machine oil 110 and the liquid refrigerant 109 are sucked into the discharge pipe 108 through the oil collecting apertures 108*a*–108*e* and flow in a mixture with the refrigerant gas.

Both the above conventional examples operate similarly and have the same problems. The operation of the conventional example shown in FIG. 22 will be described as representing the operation of the above examples and the problems of the example will be described.

The amount of the liquid refrigerant flowing into the discharge pipe 103 through the oil collecting apertures 103*a*–103*e* is increased by the increase of the flow velocity U of the gas flowing in the discharge pipe 103 and the increase of the amount of the liquid refrigerant residing in the vessel 101, that is, the increase of the height H of the liquid refrigerant. FIG. 24 shows flow amount characteristics when it is assumed that the gas flow velocity U is set to a given value and the thickness h of the refrigeration machine oil 105 flowing on the upper layer of the liquid refrigerant 104 is fixed.

In the drawing, the abscissa represents a liquid refrigerant surface height H (mm) and the ordinate represents an amount (kg/h) of liquid refrigerant flowing into the discharge pipe 103. Further, the dotted lines show the respective amounts of liquid refrigerant flowing from the respective oil collecting apertures 103*a*–103*e* and the dashed line rising to the upper right shows the sum of the liquid refrigerant flowing from the respective oil collecting apertures.

As the liquid refrigerant height H increases, the number of oil collecting apertures under the liquid refrigerant 104 increases. At the time, the amount of the liquid refrigerant flowing from the lower oil collecting apertures is greater than that flowing from the upper oil collecting apertures due to the differences in pressures applied thereto. Therefore, the total flow amount of the liquid refrigerant does not increase in proportion to the liquid refrigerant height H but accelerratively increases as the height H increases. That is, as the liquid surface height in the accumulator increases, the amount of the refrigerant 104 sucked into the discharge pipe 103 and flowing from the accumulator increases.

Next, the flow amount of oil will be described. The saw-tooth-shaped solid line in FIG. 24 indicating an approximately constant flow amount shows the amount of the refrigeration machine oil 105 which floats on the upper layer and flows into the discharge pipe 103 through the oil collecting apertures. Further, FIG. 25 shows a view explaining the change of the flow amount of the oil. The amount of the refrigeration machine oil is determined by the refrigerating/air conditioning circuit to which the accumulator is assembled. Usually, however, since the diameter of the oil collecting apertures is determined to prevent the excessive refrigeration machine oil from staying in the accumulator, the amount of refrigeration machine oil residing in the sealed vessel 101 of the accumulator barely increases or decreases. Normally, therefore, only one or two oil collecting apertures are positioned with in the thickness h of the refrigeration machine oil although this depends on the intervals between the oil collecting apertures.

FIG. 25A shows a case where the refrigeration machine oil 105 stays in the range of the oil collecting apertures 103*c* and 103*d* and FIG. 25B shows a case where it stays in the range of the oil collecting aperture 103*d* although the thickness h of the refrigeration machine oil is the same as that of FIG. 25A. That is, the state shown in FIG. 25A or the state shown in FIG. 25B may be realized depending upon the change of the liquid refrigerant height H. As a matter of course, the difference between both states results in a change of the flow amount of the oil, where the flow amount of the oil in FIG. 25A is greater than that in FIG. 25B. Therefore, even if the thickness h of the refrigeration machine oil is given, the amount of the oil flowing into the discharge pipe 103 is somewhat changed by the change of the liquid refrigerant height H. Actually, although the flow amount of the oil tends to change stepwise as shown FIG. 24, it is constant in average in comparison with the amount of the liquid refrigerant.

As is well known, refrigerant gas from the discharge pipe of an accumulator is sucked by a compressor in a refrigerating/air conditioning circuit and discharged after being compressed. When the refrigeration machine oil which separates from the liquid refrigerant is applied to an accumulator having a conventional structure, a phenomena wherein the liquid refrigerant become mixed with the refrigerant gas is caused so that the flow amount of the liquid refrigerant becomes excessive. At this time, the compressor will suck a large amount of liquid refrigerant and compress it. Thus, a liquid compressed state arises, by which abnormally high pressures are generated. Further, since the oil supply pump in the compressor sucks the liquid refrigerant and supplies it to bearings and sliding portions, the bearings will not be sufficiently lubricated. As a result, the sliding portions in the compressor may become abnormally worn or seized.

That is, the flow amount of the liquid refrigerant derived from the accumulator assembled to the refrigerating/air conditioning circuit must be smaller than a certain amount and the flow amount of the refrigeration machine oil must be larger than a certain amount for the compressor to operate smoothly. Their limit values depend upon the refrigerating/air conditioning circuit to which the accumulator is assembled.

When, for example, the diameter of the oil collecting apertures is made small to reduce the flow amount of the liquid refrigerant in the conventional arrangement, micromachining may be required which is not suitable large-scale production of the structure. Further, when the apertures have a small diameter, there is an increased possibility that the apertures may become clogged with foreign material. Consequently, the apertures must have a diameter larger than a certain degree and the diameter must be usually set to, for example, about 1.5 mm at the smallest, which, however, cannot reduce the flow amount of the liquid refrigerant.

Further, there is the following problem from the view point of the flow amount characteristics of the oil. That is, when it is assumed that the oil collecting apertures are set a small diameter, although the flow amount of the liquid refrigerant can be reduced, the flow amount of the oil is also reduced. Thus it is difficult to obtain the target flow amount of the refrigeration machine oil. In this case, since a large amount of the oil stays in the accumulator vessel, the amount of the oil in the compressor is sharply reduced.

As described above, conventional accumulators have problems in that it is difficult to properly control the flow amount of the liquid refrigerant and the flow amount of the refrigeration machine oil.

SUMMARY OF THE INVENTION

The present invention has been achieved with a view toward solving the problems described above, and it is an object of the present invention to provide an accumulator in which liquid refrigerant is prevented from excessively flowing from the accumulator even if a large amount of the liquid refrigerant resides in an accumulator vessel. Also, refrigeration machine oil staying in the accumulator can be effectively collected into a compressor by machining the diameter of oil collecting apertures to such a size as to present no obstacle in operation so that the flow amount of the liquid refrigerant flowing into the compressor is suppressed while securing the necessary flow amount of the refrigeration machine oil. As a result, the reliability of the refrigerating/air conditioning circuit can be enhanced.

To this end, according to one aspect of the present invention, there is provided an accumulator, comprising: a sealed vessel for temporarily storing refrigerant circulating in a refrigerating/air conditioning circuit; a suction pipe for introducing the refrigerant into the sealed vessel; a discharge pipe for discharging the refrigerant in the sealed vessel; and an oil collecting pipe held in the sealed vessel with the lower end thereof closed and having a plurality of oil collecting apertures spaced in a vertical direction and a communication port for communicating with the discharge pipe, the communication port being disposed in the vicinity of the lowermost oil collecting aperture of the oil collecting pipe or to the downstream side of the aperture.

According to another aspect of the present invention, there is provided an accumulator, comprising: a sealed vessel for temporarily storing refrigerant circulating in a refrigerating/air conditioning circuit; a suction pipe for introducing the refrigerant into the sealed vessel; a discharge pipe for discharging the refrigerant in the sealed vessel; a plurality of oil collecting pipes each held at a different height in the sealed vessel and having a plurality of oil collecting apertures spaced in a vertical direction and a communication port for communicating with the discharge pipe, the communication port being disposed in the vicinity of the lowermost oil collecting aperture of each of the oil collecting pipes or to the downstream side of the aperture; an opening/closing mechanism for opening and closing refrigerant passages passing through the plurality of oil collecting pipes except for the uppermost refrigerant passage; and a control mechanism for actuating the opening/closing mechanism according to the liquid surface height in the sealed vessel; wherein the refrigerant passages are arranged in such a manner that the upper ends of the oil collecting pipes except for the uppermost pipe are closed, the opening/closing mechanism is actuated by the control mechanism in accordance with the liquid surface height in the sealed vessel and the oil collecting pipes in operation among the plurality of oil collecting pipes are switched.

According to a still further aspect of the present invention, there is provided an accumulator, comprising: a sealed vessel for temporarily storing refrigerant circulating in a refrigerating/air conditioning circuit; a suction pipe for introducing the refrigerant into the sealed vessel; a discharge pipe for discharging the refrigerant in the sealed vessel; a plurality of oil collecting pipes held in the sealed vessel with the upper ends thereof opened and having a different length; and a gathering pipe connected to each of the oil collecting pipes at a position below the upper end thereof and having a communication port for communicating with the discharge pipe.

DETAILED DESCRIPTION OF THE PREFERRED EMBODIMENTS

The embodiments according to the present invention will now be described with reference to the accompanying drawings.

First Embodiment

Figure 1A:
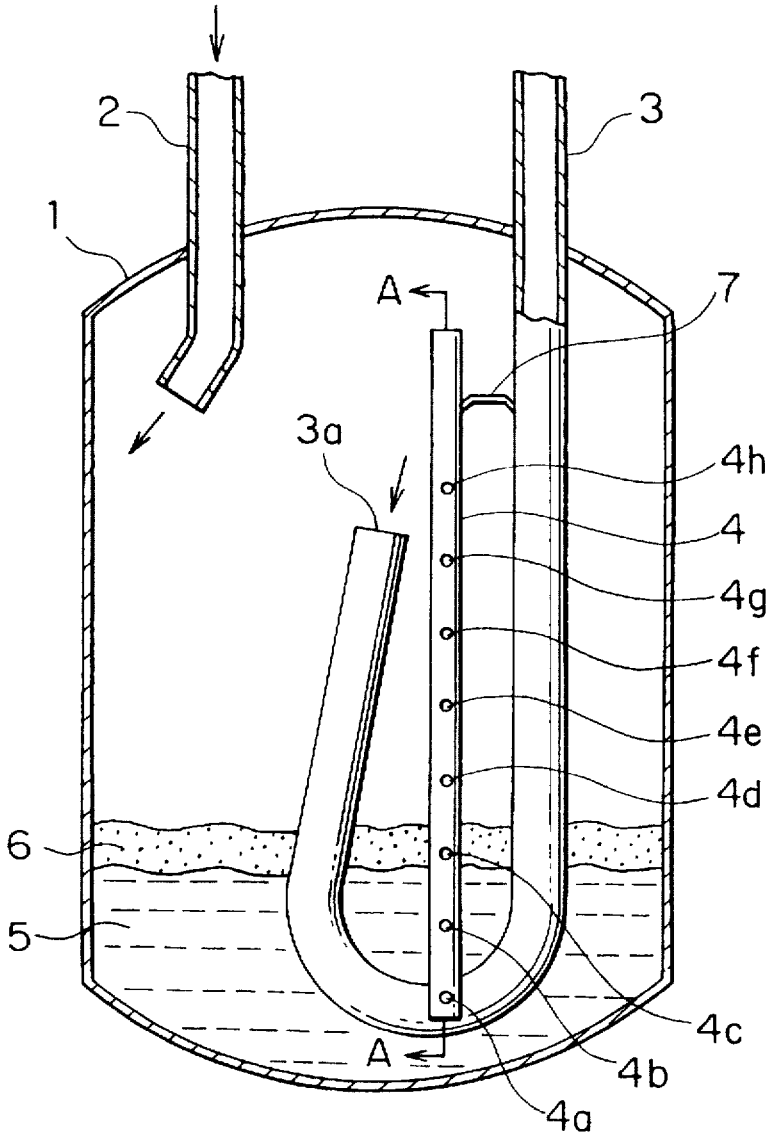
FIG. 1A is a longitudinal cross sectional view showing an accumulator according to a first embodiment of the present invention.
Figure 1B:
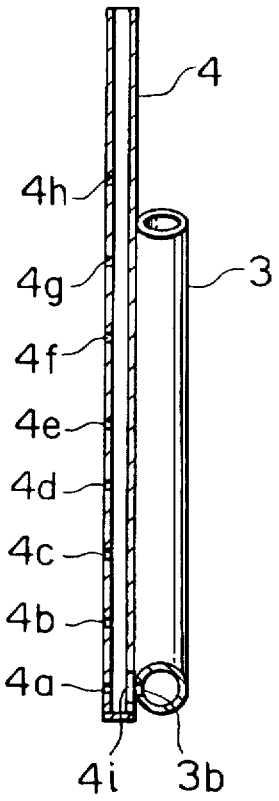
FIG. 1B is a cross sectional view taken along the line A—A of FIG. 1A.

FIG. 1A is a longitudinal cross sectional view showing an accumulator according to a first embodiment of the present invention. FIG. 1B is a cross sectional view taken along the line A—A of FIG. 1A.

In the drawings, a sealed vessel 1 is provided with a suction pipe 2 and a discharge pipe 3 having a refrigerant gas inlet 3*a* and a communication port 3*b*. An oil collecting pipe 4 is disposed in the sealed vessel 1 and provided with a plurality of oil collecting apertures 4*a*–4*h* disposed in a vertical direction and a communication port 4*i* communicated with the discharge pipe 3. Liquid refrigerant 5 and refrigeration machine oil 6 resides in the sealed vessel 1. The oil collecting pipe 4 is fixed to the discharge pipe 3 through a reinforcing member 7. The communication port 3b and the oil collecting apertures 4a–4h are arranged to have, for example, an orifice structure and basically formed to a circular shape, although they are arranged likewise when they are not formed in a circular shape. The communication port 3b is disposed in the vicinity of the lowermost oil collecting aperture 4a or nearer to the downstream side of the refrigerant passage than the aperture 4a.

Figure 2A:
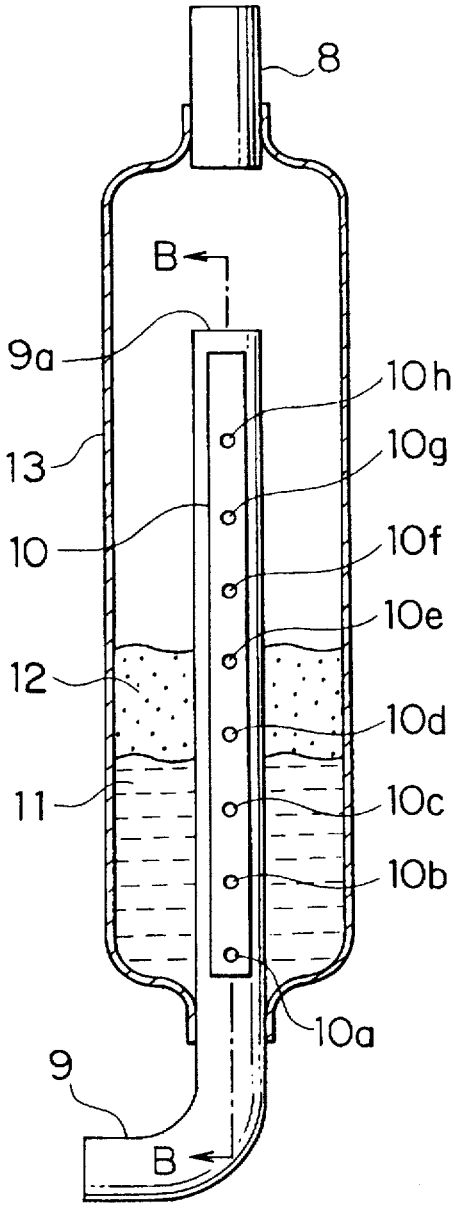
FIG. 2A is a longitudinal cross sectional view showing another accumulator according to the first embodiment.
Figure 2B:
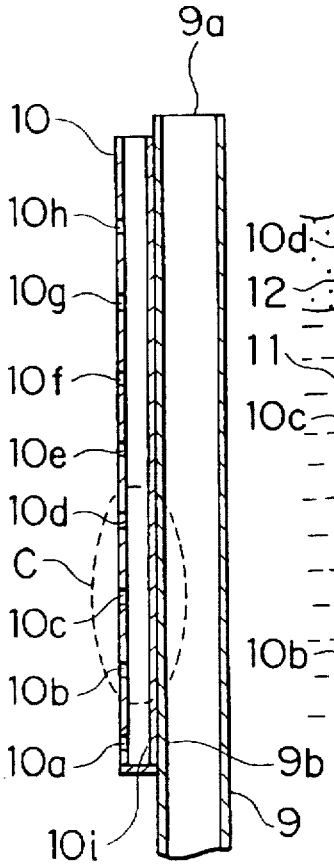
FIG. 2B is a cross sectional view taken along the line B—B of FIG. 2A.
Figure 2C:
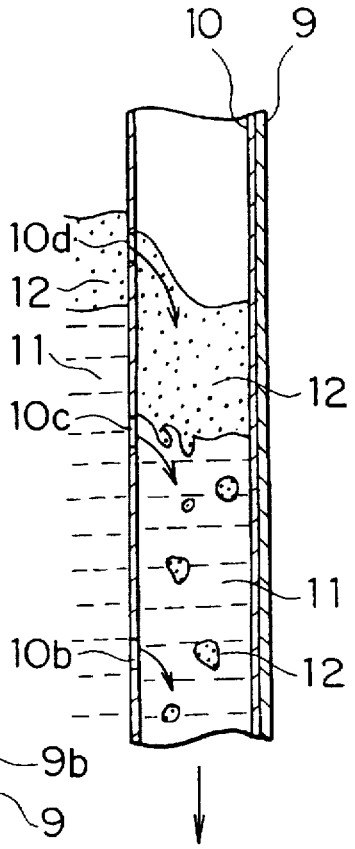
FIG. 2C is a view explaining the internal flow of liquid refrigerant and refrigeration machine oil.

FIG. 2A is a longitudinal cross sectional view showing another accumulator according to the first embodiment. FIG. 2B is a cross sectional view taken along the line B—B of FIG. 2A. FIG. 2C is a view explaining the internal flow of liquid refrigerant and refrigeration machine oil.

In the drawings, a suction pipe 8 is connected to a sealed vessel 13. A discharge pipe 9 is inserted into the sealed vessel 13 and is provided with a refrigerant gas inlet 9a and a communication port 9b. An oil collecting pipe 10 is fixed to the discharge pipe 9 and provided with oil collecting apertures 10a–10h and a communication port 10i with the discharge pipe 9. Liquid refrigerant 11 and refrigeration machine oil 13 resides in the sealed vessel 1.

In FIGS. 1A to 2B, the diameter of the oil collecting apertures defined in the oil collecting pipes is set to about 1–3 mm which causes no obstacle in machining.

Although the operation of the embodiment will be described as to the accumulator arranged as shown in FIG. 2, the accumulator arranged as shown in FIG. 1 operates in a similar manner.

The accumulator functions to temporarily store refrigerant circulating in a refrigerating/air conditioning circuit. The refrigerant gas flowing from the suction pipe 8 is separated from the liquid refrigerant, the liquid refrigerant 11 is stored in the sealed vessel 13 to prevent it from being supplied to a compressor (not shown) and the refrigerant machine oil 12 stored in the sealed vessel 13 is returned to the compressor. FIG. 2A shows a state where the fluid of the liquid refrigerant 11 and the refrigerant machine oil 12 mixed with the refrigerant gas from the suction pipe 8 is separated therefrom in the sealed vessel 13 and the liquid refrigerant 11 and the refrigerant machine oil 12 stay in the sealed vessel 13. Since the liquid refrigerant 11 and the refrigerant machine oil 12 have little solubility, they stay in the lower portion of the sealed vessel 13 in a separated state. Usually, since the specific gravity of the refrigerant machine oil 12 is less than that of the liquid refrigerant 11, the refrigerant machine oil 12 floats on the upper layer of the liquid refrigerant 11.

One function of the accumulator is returning the refrigerant machine oil 12 to the compressor by sucking it into the discharge pipe 9 regardless of the amount of liquid refrigerant 11 residing therein, that is, even if the height of the liquid refrigerant 11 varies.

In this embodiment, the plurality of oil collecting apertures 10a–10h are vertically disposed along the axis of the oil collecting pipe 10 to collect the refrigerant machine oil 12 floating on the liquid refrigerant 11 into the oil collecting pipe 10. As shown in FIG. 2B, the communication port 10i disposed to the lower portion of the oil collecting pipe 10 is made to communicate with the communication port 9b disposed in the discharge pipe 9 so that the liquid refrigerant 11 and the refrigerant machine oil 12 in the oil collecting pipe 10 can be sucked into the discharge pipe 9. As seen from FIG. 2C, the liquid refrigerant 11 in the oil collecting pipe 10 is mixed with the refrigerant machine oil 12 therein and the refrigerant machine oil 12 entering the oil collecting pipe 10 is accompanied by the flow of the liquid refrigerant 11 in the oil collecting pipe 10, passes through the communication ports 10i, 9b and is further sucked into the discharge pipe 9. The refrigerant machine oil 12 floating on the upper layer of the liquid refrigerant 11 in the sealed vessel 13 is sucked into the discharge pipe 9 as described above.

Figure 3A:
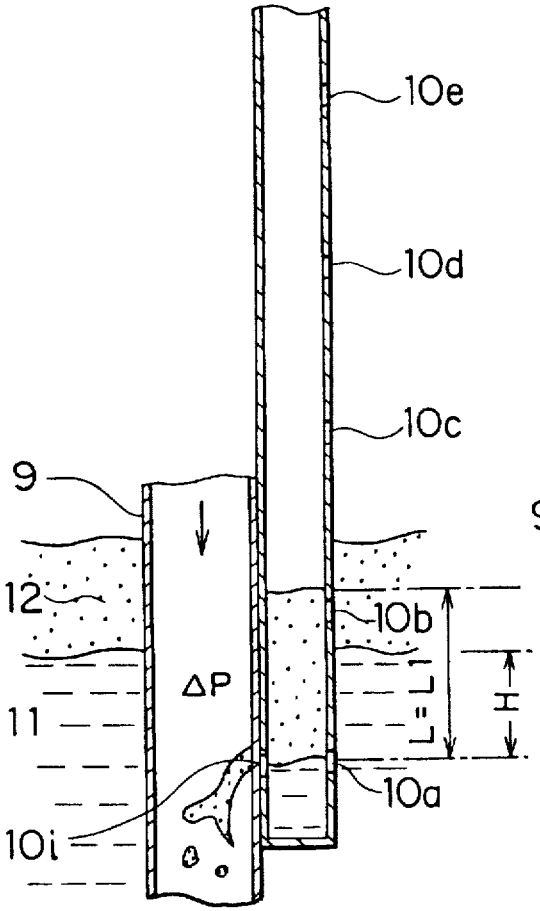
FIG. 3 is a view explaining the internal flow of liquid refrigerant and refrigeration machine oil according to the first embodiment.

Next, the flow amount characteristics of the liquid refrigerant 11 and the refrigerant machine oil 12 will be described. FIG. 3 shows the internal flow and the liquid surface height in the discharge pipe 9 and the oil collecting pipe 10, wherein FIG. 3A shows a case where the liquid surface height H in the sealed vessel 13 is low and FIG. 3B shows a case where the liquid surface height H is high.

Figure 3B:
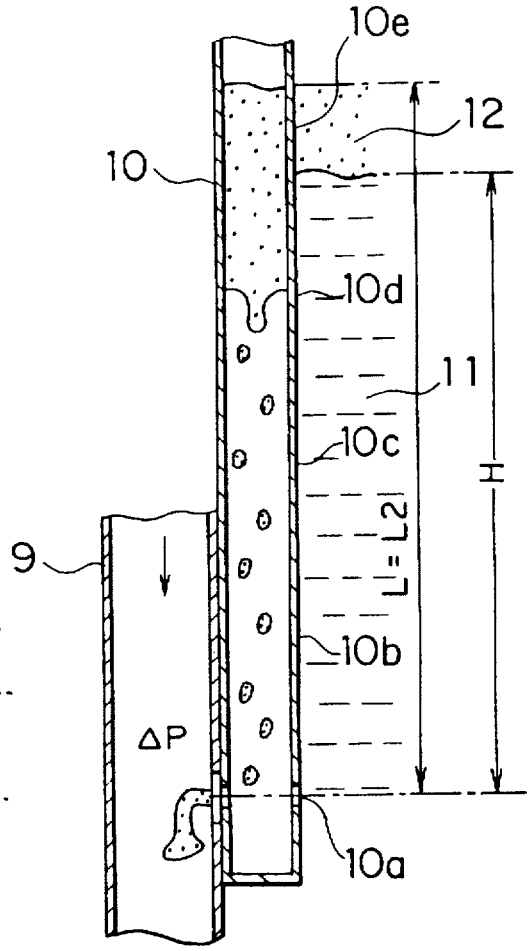

In the drawings, symbol L denotes the liquid surface height in the oil collecting pipe 10, symbol L1 corresponds to the case where the liquid surface height is low (FIG. 3A) and symbol L2 corresponds to the case where the liquid surface height is high (FIG. 3B). The pressure in the communication port 10i drops by $\Delta P$ as compared with that in the sealed vessel 13 due to the refrigerant gas flowing in the discharge pipe 9. The total flow amount Q of the liquid refrigerant 11 and the refrigerant machine oil 12 which flow in the communication port 10i is shown by $Q \propto \sqrt{(\Delta P+\rho gL)}$, where $\rho$ represents liquid density and g represents gravity acceleration.

The number of oil collecting apertures (10a–10e) into which the liquid refrigerant 11 and the refrigerant machine oil 12 flow is increased by the increase in the liquid surface height H in the sealed vessel 13 to increase the liquid surface height L in the oil collecting pipe 10 accordingly. The total flow amount Q of the liquid refrigerant 11 and the refrigerant machine oil 12 which flow in the communication port 10i is determined by $Q \propto \sqrt{(\Delta P+\rho gL)}$, so that the total flow amount characteristics Q shown in FIG. 4 can be obtained.

Next, the ratio between the flow amount of the liquid refrigerant and that of the refrigeration machine oil will be described.

In the oil collecting pipe 10 arranged as described above, when the oil collecting apertures have the same size and are disposed at the same intervals, the inflow at the respective oil collecting apertures is approximately the same. As a result, where an oil collecting aperture 10a and oil collecting aperture 10b are disposed as shown in FIG. 3A the liquid refrigerant 11 and the refrigerant machine oil 12 respectively flow in approximately equal amounts. Further, in FIG. 3B, where four oil collecting apertures 10a–10d are disposed into which the liquid refrigerant 11 flows the one oil collecting aperture 10e is disposed into which the refrigerant machine oil 12 flows, the flow amount of the refrigerant machine oil 12 is approximately one fifth the total flow amount Q. The flow amount characteristics of the refrigerant machine oil 12 and the liquid refrigerant 11 are determined as described above. Thus the flow amount of the liquid refrigerant and the flow amount of the refrigeration machine oil shown in FIG. 4 can be obtained.

Figure 4:
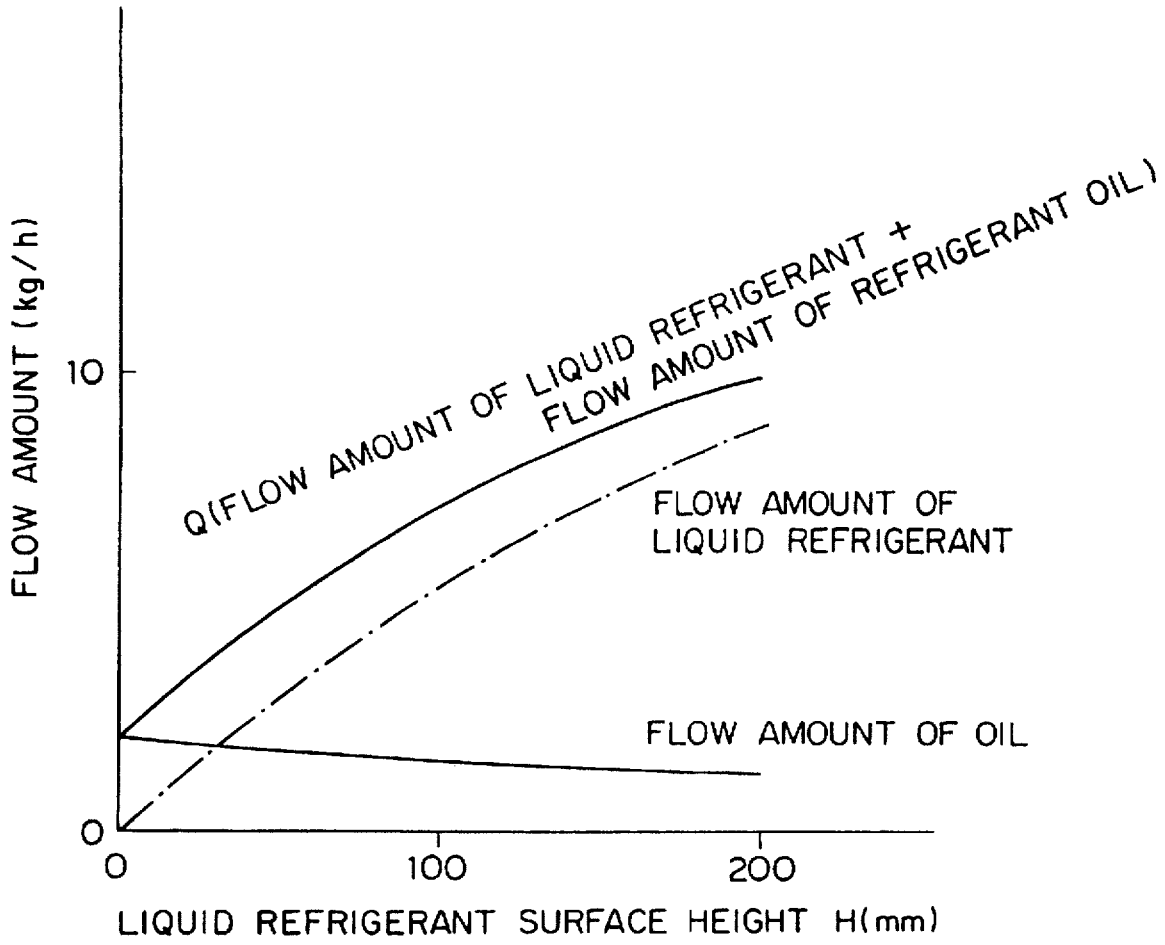
FIG. 4 is a characteristic graph showing the relationship between the flow amounts (kg/h) of liquid refrigerant and refrigeration machine oil and a liquid refrigerant surface height (mm) according to the first embodiment.
Figure 24:
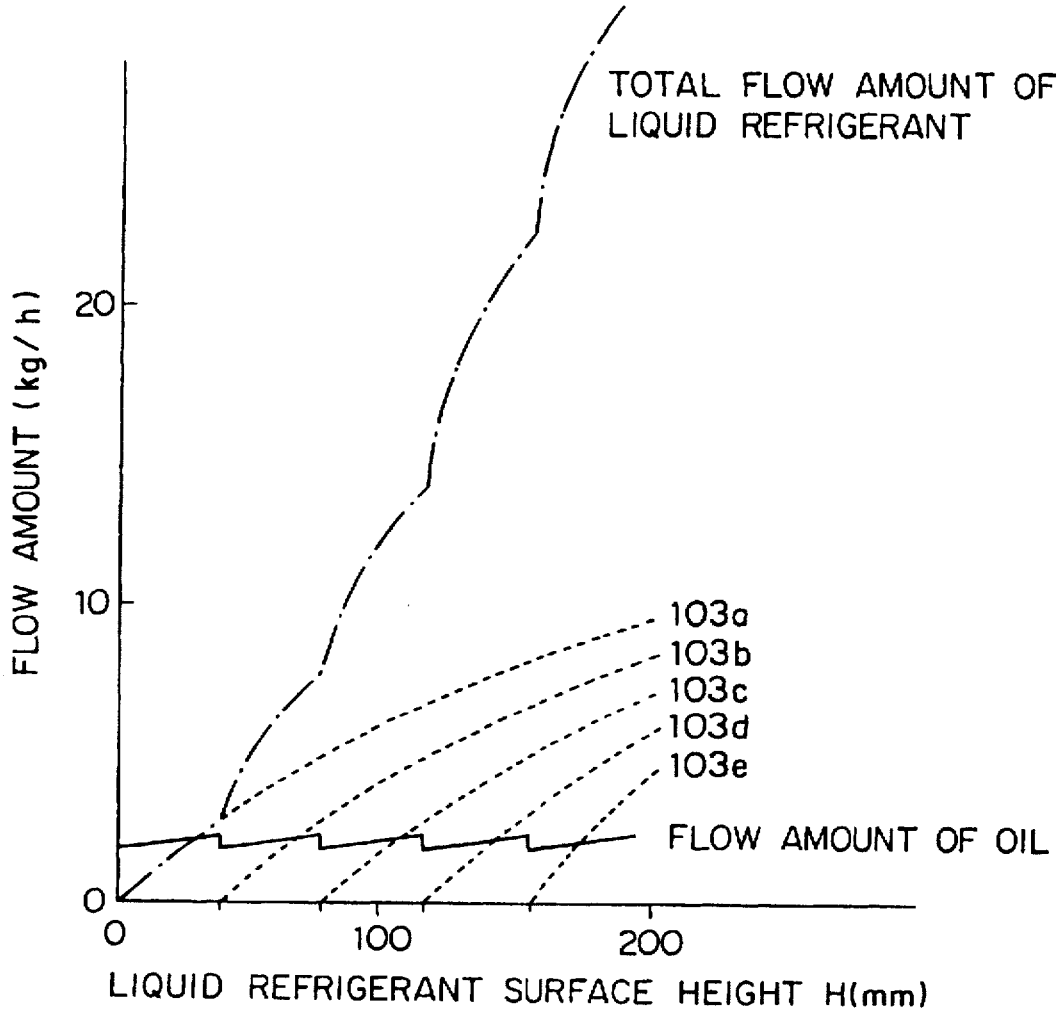
FIG. 24 PRIOR ART
FIG. 24 is a characteristic graph showing the relationship between the flow amounts (kg/h) of liquid refrigerant and refrigeration machine oil and a liquid refrigerant surface height (mm) according to the conventional accumulator.
Figure 25A:
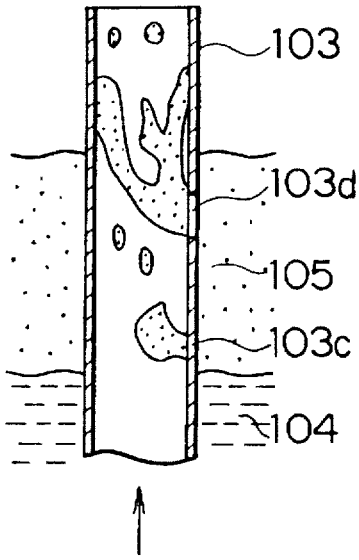
FIG. 25A is a view explaining the change of the flow amount of oil of the conventional accumulator.
Figure 25B:
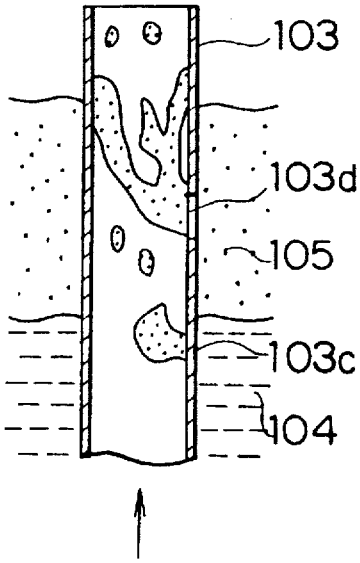
FIG. 25B is a view explaining the change of the flow amount of oil of the conventional accumulator.

In FIG. 4, the abscissa represents the liquid surface height H (mm) of the liquid refrigerant and the ordinate represents the flow amount from the oil collecting pipe 10 to the discharge pipe 9. When the flow amount characteristics of the liquid refrigerant obtained by the embodiment are compared with the flow amount characteristics of the liquid refrigerant of the conventional accumulator shown in FIG. 24, the former characteristics are clearly different from the latter characteristics and this embodiment can greatly reduce the increase of the flow amount of the liquid refrigerant caused by an increase of the liquid surface height H.

As described above, since this embodiment is provided with the oil collecting pipe having the plurality of oil collecting apertures vertically spaced therein and the oil collecting pipe is made to communicate with the discharge pipe through the single orifice-shaped communication aperture, even if the height of the liquid refrigerant in the sealed vessel 13 increases, the amount of the liquid refrigerant sucked into the discharge pipe 9 is not increased as in the conventional example. Thus excessive flow of the liquid refrigerant from the accumulator can be prevented and the refrigeration machine oil remaining, the accumulator can be effectively collected to the compressor. Therefore, the amount of the liquid refrigerant flowing into the compressor can be suppressed and the necessary flow amount of the refrigeration machine oil can be secured. As a result, the reliability of the refrigerating/air conditioning circuit can be improved.

Second Embodiment

Figure 5A:
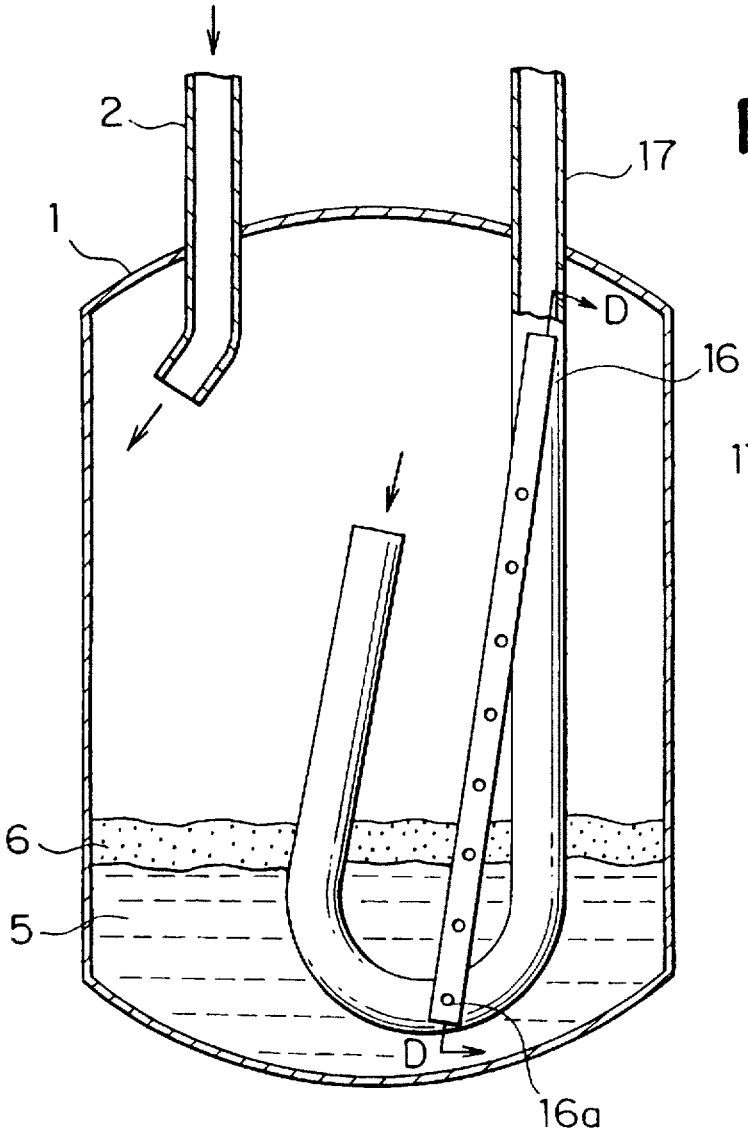
FIG. 5A is a longitudinal cross sectional view showing an accumulator according to a second embodiment of the present invention.
Figure 5B:
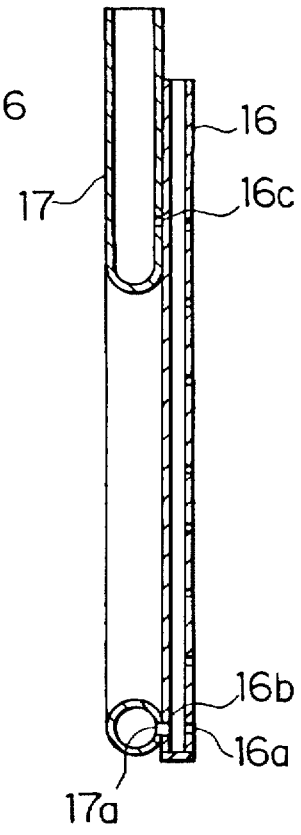
FIG. 5B is a cross sectional view taken along the line D—D of FIG. 5A.

The arrangement of an oil collecting pipe of a second embodiment will now be described. FIG. 5A is a longitudinal cross sectional view showing an accumulator according to the second embodiment of the present invention. FIG. 5B is a cross sectional view taken along the line D—D of FIG. 5A. This embodiment makes the reinforcing member for supporting the oil collecting pipe in the arrangement of FIG. 1A unnecessary for simplification. In the drawings, an oil collecting pipe 16 is provided with a plurality of oil collecting apertures 16*a*, a communication port 16*b*. Also, the oil collecting pipe 16 is fixed to a discharge pipe 17 at the communication port 16*b* and a fixed point 16*c*.

The oil collecting pipe 16 is connected to the discharge pipe 17 through the communication ports 16*a*, 17*a* defined in them, respectively. When the plurality of oil collecting apertures 16*a* have the same size and are disposed at the same intervals, an advantage similar to that of the first embodiment can be obtained. In addition, since the oil collecting pipe 16 can be fixed without the provision of the reinforcing member 7 in FIG. 1A, the arrangement can be simplified.

Third Embodiment

Figure 6A:
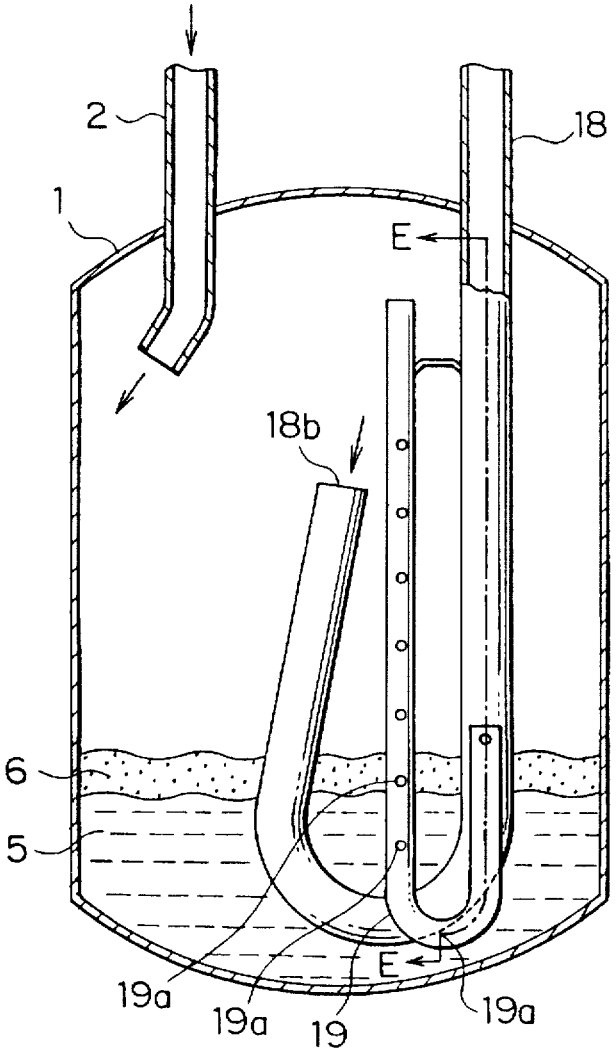
FIG. 6A is a longitudinal cross sectional view showing an accumulator according to a third embodiment of the present invention.
Figure 6B:
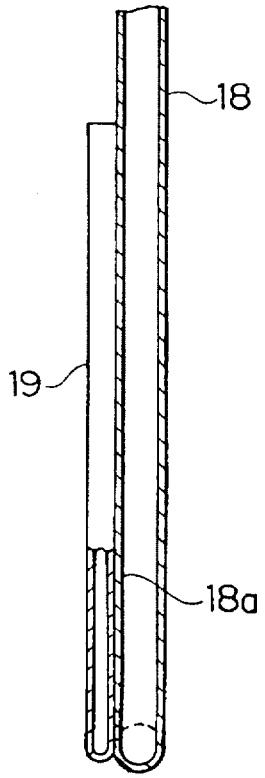
FIG. 6B is a cross sectional view taken along the line E—E of FIG. 6A.

Next, the structure of an oil collecting pipe of an accumulator according to a third embodiment of the present invention will be described. FIG. 6A is a longitudinal cross sectional view showing an accumulator according to the third embodiment of the present invention. FIG. 6B is a cross sectional view taken along the line E—E of FIG. 6A.

In the drawings, a discharge pipe 18 is inserted into the sealed vessel 1 and provided with a communication port 18*a* and a gas inlet 18*b*. An oil collecting pipe 19 is provided with a plurality of oil collecting apertures 19*a*. In this embodiment, the communication port 18a is located at a high position nearer to the downstream side of a refrigerant passage than the oil collecting aperture disposed to the lowermost position of the J-shaped oil collecting pipe 19. It also communicates on the J-shaped discharge pipe 18 side with the oil collecting pipe 19 at a high position nearer to the downstream side of the refrigerant passage than the lowermost portion of the discharge pipe 18.

The operation will be described below. The disposition of the communication port 18*a* at the position shown in the drawing increases the distance from the gas inlet 18*b* of the discharge pipe to the communication port 18*a*, by which the pressure loss $\Delta P$ generated in the pipe within the above range is made larger than that in the first embodiment. As described above, since the total flow amount Q of the liquid refrigerant 5 and the refrigerant machine oil 6 flowing through the communication port 18*a* is determined by $Q \propto \sqrt{(\Delta P+\rho gL)}$, the total flow characteristics Q in this embodiment are increased over those in the first embodiment. Since the ratio of the refrigeration machine oil contained in the total flow amount Q is the same, the flow amount of the refrigeration machine oil is also increased by the increase of the total flow amount Q.

Although there is an obstacle when the total flow amount Q is excessively increased as described above, the total flow amount Q in this embodiment does not increase accelerratively as in the conventional example. Also, there is an advantage in that the refrigeration machine oil can be increased.

The total flow amount Q of the liquid refrigerant and the refrigeration machine oil can be adjusted by changing the position where the communication port is connected to the discharge pipe as described above. That is, the communication port 18*a* need not be always disposed at the lowermost portion of the discharge pipe as found in the first embodiment and the characteristics of the flow mount to the discharge pipe 18 can be adjusted by communicating the oil collecting pipe 19 with the discharge pipe 18 in the vicinity of the lowermost oil collecting aperture or at any arbitrary position on the downward stream side therefrom. As a result, this embodiment has an advantage in that the operating conditions of the refrigerating/air conditioning circuit to which the accumulator is assembled can optimized as well as advantages similar to the first embodiment.

Fourth Embodiment

The arrangement and operation of an accumulator according to a fourth embodiment of the present invention will be described below. This embodiment relates to the shape of a communication port and reduces the effect of on flow amount caused by the viscosity of the fluid flowing the communication port.

Figure 7A:
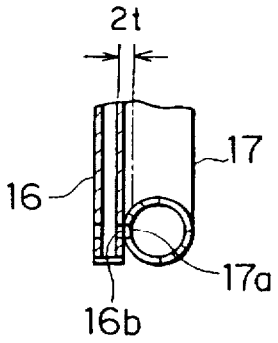
FIG. 7A is a cross sectional view showing the vicinity of the communication port of the accumulator according to the first embodiment.

FIG. 7A shows an arrangement where the diameter of the communication port 16*b* of an oil collecting pipe 16 is the same as the diameter of the communication aperture 17*a* of a discharge pipe 17. When the oil collecting pipe 16 and the discharge pipe 17 have the same wall thickness, the length of the passage in the flow direction corresponds to twice the wall thickness t of the pipe. Further, FIG. 7B shows an arrangement where the diameter of the communication port 16*c* of the oil collecting pipe 16 is larger than the diameter of the communication port 17*a* of the discharge pipe 17, in which the length of the passage in the flow direction corresponds to the wall thickness t of the pipe.

Figure 7B:
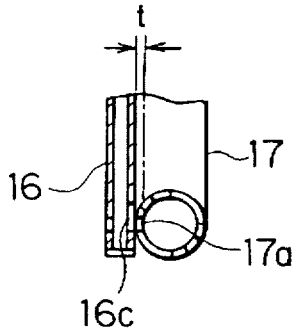
FIG. 7B is a cross sectional view showing a vicinity of a communication port of an accumulator according to a fourth embodiment of the present invention.

In a comparison of the arrangement of FIG. 7A with that of FIG. 7B, although the cross sectional areas of the communication ports are the same, the length of the passage in the flow direction is longer in FIG. 7A. Therefore, when, for example, refrigeration machine oil having a high viscosity flows in the arrangement of FIG. 7A, the resistance of the passage is increased, thus reducing the flow amount. On the other hand, when the diameter of one of the communication ports 16*b* or 17*a* is made larger than that of the other to substantially reduce the length of the passage as in FIG. 7B, the change of passage caused by the effect of viscosity can be suppressed.

Although the diameter of communication port 16*c* is larger than that of communication port 17*a* in FIG. 7B, the diameter of communication port 17*a* may be larger than that of communication port 16*c*.

Fifth Embodiment

The structure of an oil collecting pipe of an accumulator according to a fifth embodiment of the present invention will be described below. This embodiment is arranged to more effectively feed the refrigeration machine oil flowing into the oil collecting pipe.

Figure 8A:
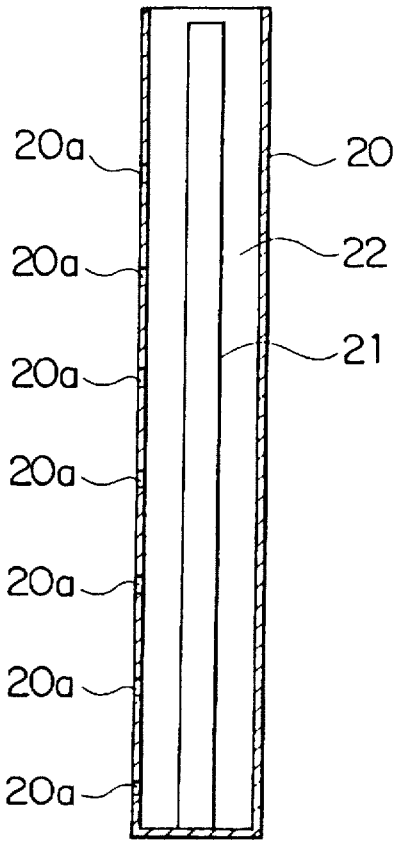
FIG. 8A is a longitudinal cross sectional view showing an oil collecting pipe of an accumulator according to a fifth embodiment of the present invention.
Figure 8B:
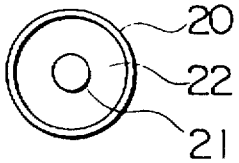
FIG. 8B is an upper plan view of FIG. 8A.

FIG. 8A is a longitudinal cross sectional view showing an oil collecting pipe of an accumulator according to the fifth embodiment of the present invention. FIG. 8B is an upper plan view of FIG. 8A. The oil collecting pipe 20 is provided with a plurality of oil collecting apertures 20*a*. A columnar member 21 is held in the vicinity of the center of the oil collecting pipe 20 and an annular space 22 is defined between the inner wall of the oil collecting pipe 20 and the side surface of the columnar member 21.

Figure 9A:
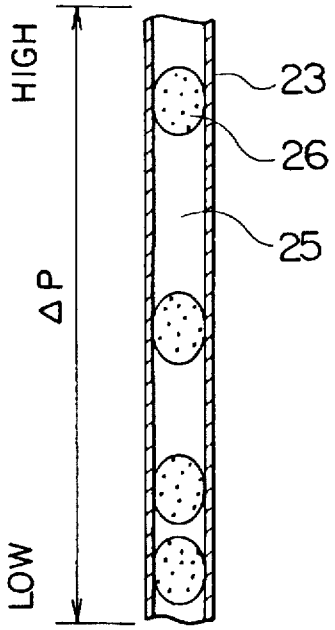
FIG. 9A is a view explaining the flow of liquid refrigerant and refrigeration machine oil in an oil collecting pipe having a thin diameter.
Figure 9B:
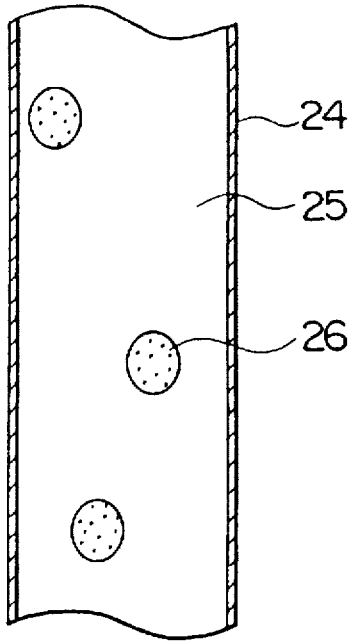
FIG. 9B is a view explaining the flow of liquid refrigerant and refrigeration machine oil in an oil collecting pipe having a thick diameter.

FIGS. 9A and 9B are views explaining the operation of the oil collecting pipes, wherein FIG. 9A shows a case where the oil collecting pipe 23 has a thin diameter of about 4–5 mm and FIG. 9B shows a case where the oil collecting pipe 24 has a thick diameter of about 10 mm. In the drawings, symbol ΔP denotes a pressure difference acting on the oil collecting pipes 23, 24 where the lower portions of the pipes are under low pressure to communicate with the discharge pipes.

Next, how the flowing state changes in relation to the diameter of the oil collecting pipe will be described with reference to FIG. 9. The minimum diameter of an oil droplet 26 is determined by the surface tension of the refrigeration machine oil 26 and the liquid refrigerant 25. FIG. 9A shows an arrangement where the diameter of the droplet 26 is approximately the same as the inside diameter of the pipe and the liquid refrigerant 25 flows so as to push out the droplet 26. Since the pressure difference ΔP acts on the droplet 26 in this state, the droplet 26 and liquid refrigerant 25 form a continuous flow. Since there is a difference between the specific gravity of the refrigeration machine oil and that of the liquid refrigerant, the droplet 26 flows by being pushed downward by the liquid refrigerant 25 although buoyancy acts on the droplet 26. On the other hand, since the droplet 26 can move freely in the arrangement of FIG. 9B in which the oil collecting pipe 24 has a large diameter, the falling flow velocity of the droplet 26 is slower than that in FIG. 9A. As described above, when the diameter of the flow passage of the oil collecting pipe is approximately as small as the droplet, the state shown in FIG. 9A can be created, which permits the droplet 26 to more easily flow downward.

FIG. 8 shows a structure in which the above idea is specifically realized in the accumulator. In FIG. 8, the shape of a flow passage is changed from a cylindrical pipe to the annular space 22. To achieve the arrangement, for example, where the cross sectional area of the annular space 22 serving as the flow passage is equal to the cross sectional area of a circular pipe having an inside diameter of 10 mm, a pipe having an inside diameter of 11.7 mm, for example, is used as the oil collecting pipe 20 and a columnar member having an outside diameter of 6 mm is fixed therein. At the time, the diameter of a droplet capable of passing through the annular space 22 is 2.9 mm. That is, the slight increase in diameter of the oil collecting pipe 20 and the provision of the columnar member 21 therein permit the space in the flow passage to be adjusted to correspond to the diameter of the droplet of the refrigeration machine oil while maintaining a large cross sectional area of the pipe. Therefore, the flowing state of the droplet 26 will be near the state shown in FIG. 9A, so that a state where the droplet can easily flow against buoyancy can be realized.

Sixth Embodiment

The structure of an oil collecting pipe of an accumulator according to a sixth embodiment of the present invention will be described below. This embodiment is arranged to effectively feed the refrigeration machine oil flowing into the oil collecting pipe.

Figure 10A:
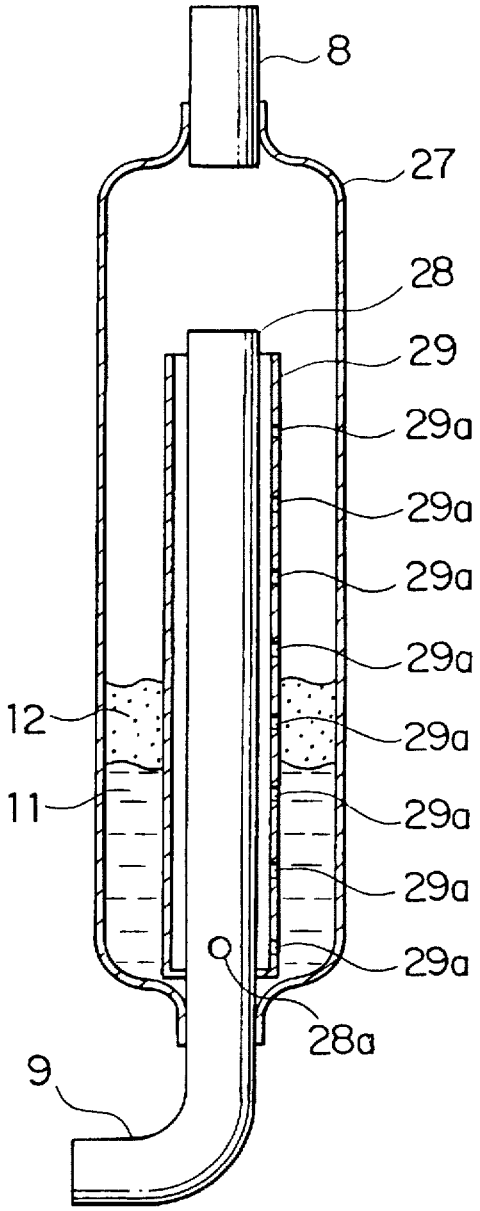
FIG. 10A is a longitudinal cross sectional view showing an accumulator according to a sixth embodiment of the present invention.
Figure 10B:
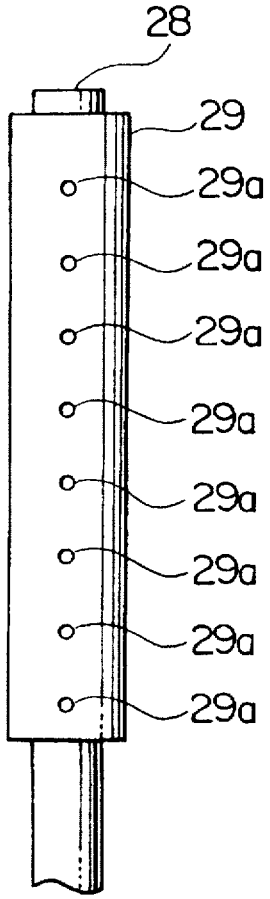
FIG. 10B is a front elevational view of an oil collecting pipe of FIG. 10A.

FIG. 10A is a longitudinal cross sectional view showing an accumulator according to the sixth embodiment of the present invention. FIG. 10B is a front elevational view of the oil collecting pipe of FIG. 10A.

In the drawings, a discharge pipe 28 is inserted into a sealed vessel 27. A communication port 28*a* is disposed to the lower portion of the discharge pipe 28. A cylindrical oil collecting pipe 29 is disposed to surround the discharge pipe 28 to define an annular space between itself and the discharge pipe 28. A plurality of oil collecting apertures 29*a* are disposed in the side surface of the oil collecting pipe 29.

The operation of this embodiment will be described below. As in the fifth embodiment, the liquid refrigerant 11 and the refrigerant machine oil 12 flowing into the cylindrical oil collecting pipe 29 through the oil collecting apertures 29*a* flow downward through the annular space formed between the inner wall of the cylindrical oil collecting pipe 29 and the side surface of the discharge pipe 28. They flow into the discharge pipe 28 through the communication port 28*a* disposed to the lower portion. The oil can easily flow through the annular space against buoyancy because the space is made to be approximately as small as the diameter of an droplet in the flow passage. Thus, the flow amount of the refrigerant machine oil 12 is increased and the amount of the refrigerant machine oil 12 collected into the compressor can be increased.

In addition, since the length of the communication port 28*a* in the direction of flow can comprise the wall thickness of the discharge pipe 28, as described in FIG. 7B, flow amount characteristics of the liquid refrigerant 11 and the refrigerant machine oil 12 which depend little on viscosity can be realized.

Seventh Embodiment

The arrangement of an oil collecting pipe of an accumulator according to a seventh embodiment of the present invention will be described below. This embodiment is arranged to relatively increase the amount of refrigeration machine oil to be collected in a state where a large amount of the liquid refrigerant and the refrigeration machine oil resides in the accumulator to increase the amount of refrigeration machine oil supplied to the compressor so that the reliability of the compressor is enhanced.

Figure 11A:
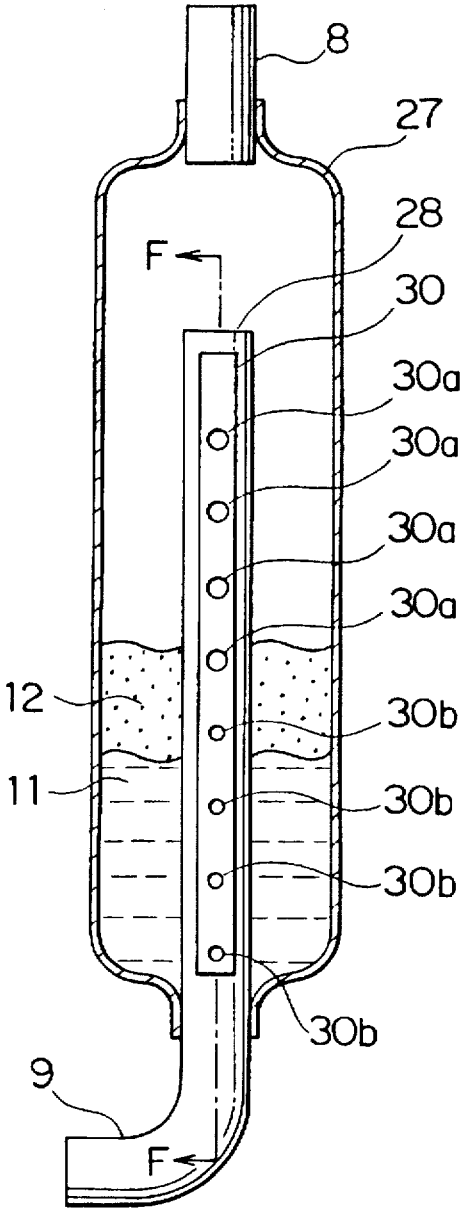
FIG. 11A is a longitudinal cross sectional view showing an accumulator according to a seventh embodiment of the present invention.
Figure 11B:
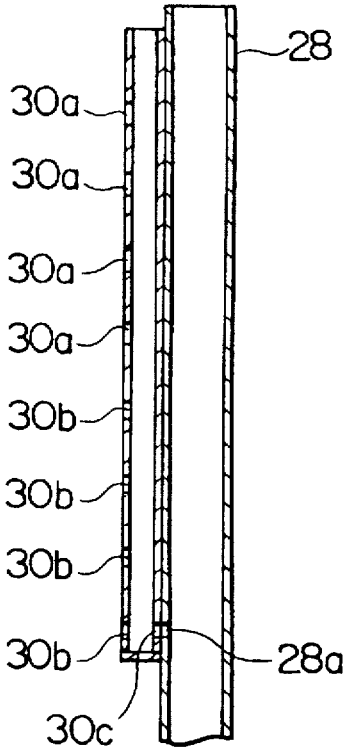
FIG. 11B is a cross sectional view taken along the line F—F of FIG. 11A.

FIG. 11A is a longitudinal cross sectional view showing an accumulator according to the seventh embodiment of the present invention. FIG. 11B is a cross sectional view taken along the line F—F of FIG. 11A. In the drawings, an oil collecting pipe 30 is provided with a plurality of oil collecting apertures 30*a* and 30*b*. The diameter of the oil collecting apertures 30*b* are smaller than those of the oil collecting apertures 30*a*. For example, the cross sectional area of an oil collecting aperture 30*b* is about one fourth the cross sectional area of the oil collecting aperture 30*a*.

Figure 12:
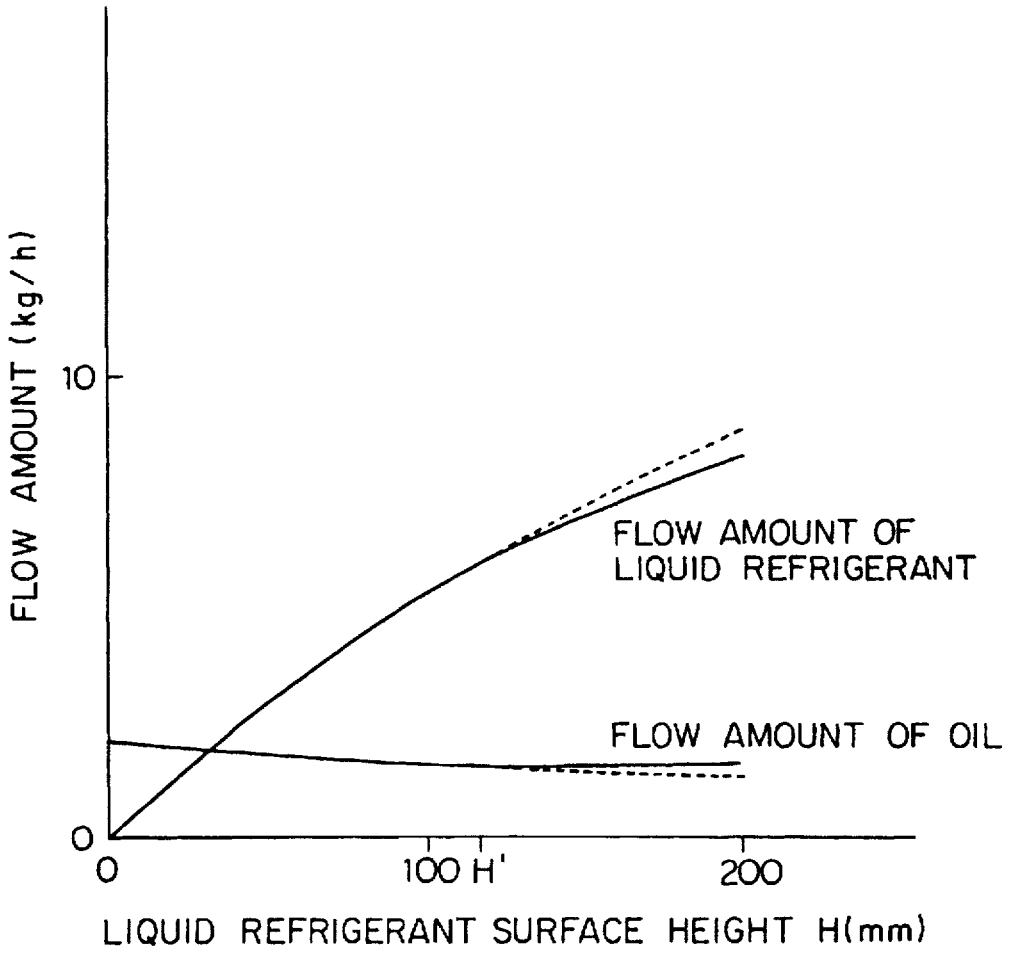
FIG. 12 is a characteristic graph showing the relationship between the flow amounts (kg/h) of liquid refrigerant and refrigeration machine oil and a liquid refrigerant surface height (mm) according to the seventh embodiment of the present invention.

The operation will be described below. When the diameter of the upper oil collecting apertures 30*a* is larger than that of the lower oil collecting apertures 30*b*, the ratio of the amount of the liquid refrigerant flowing from the lower oil collecting apertures 30*b* is relatively reduced, so that the flow amount characteristics shown in FIG. 12 are obtained. In FIG. 12, the abscissa represents a liquid surface height H (mm) and the ordinate represents the flow amount (kg/h) of the fluids flowing into the discharge pipe 28 through a communication port 30*c*. The solid line in the drawing shows the flow amount characteristics obtained by this embodiment and the dotted line shows the flow amount structure when all the oil collecting apertures have the same diameter.

As is apparent from FIG. 12, according to the arrangement of this embodiment, both reductions in the flow amount of the refrigeration machine oil and increases in the flow amount of the liquid refrigerant can be eased in the region where the liquid surface height H is high. As a result, even if a large amount of the liquid refrigerant and the refrigeration machine oil remain, the refrigeration machine oil can be stably supplied to the compressor and the reliability of the compressor can be enhanced.

Further, by changing the diameters of the oil collecting apertures in the upper and lower portions, the flow amount characteristics of the liquid refrigerant 11 and the refrigerant machine oil 12 flowing into the oil collecting pipe 30 can be adjusted.

Eighth Embodiment

The structure of an oil collecting pipe of an accumulator according to an eighth embodiment of the present invention will be described below. This embodiment is arranged to relatively increase the amount of refrigeration machine oil to be collected in a state where a large amount of the liquid refrigerant and the refrigeration machine resides in the accumulator to increase the amount of refrigeration machine oil supplied to the compressor so that the reliability of the compressor is enhanced.

Figure 13A:
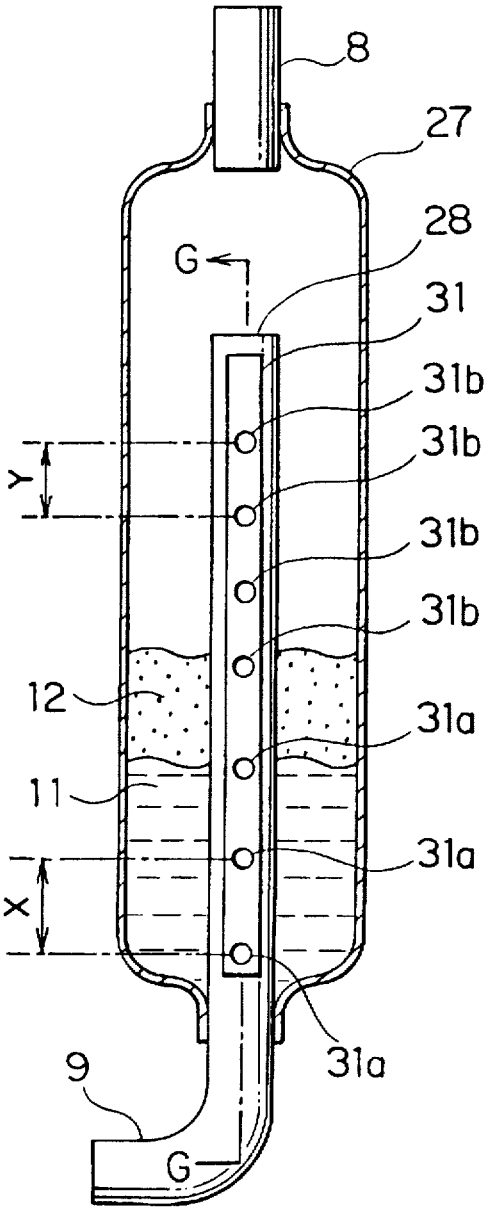
FIG. 13A is a longitudinal cross sectional view showing an accumulator according to an eighth embodiment of the present invention.
Figure 13B:
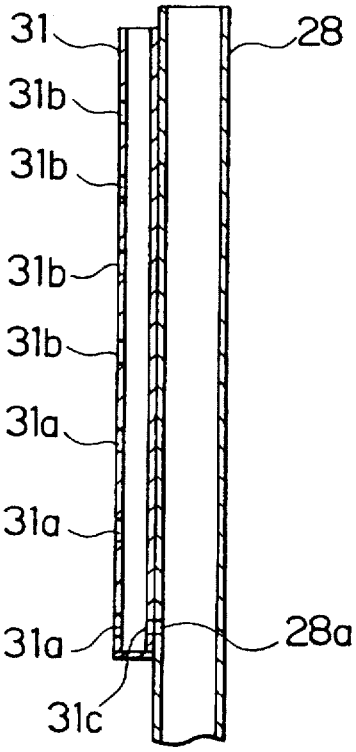
FIG. 13B is a cross sectional view taken along the line G—G of FIG. 13A.

FIG. 13A is a longitudinal cross sectional view showing an accumulator according to the eighth embodiment of the present invention. FIG. 13B is a cross sectional view taken along the line G—G of FIG. 13A. In the drawings, an oil collecting pipe 31 is provided with oil collecting apertures 31*a* and 31*b*. The interval Y between adjacent oil collecting apertures 31*b* is made narrower than the interval X between adjacent oil collecting apertures 31*a*. For example, the interval between the oil collecting apertures 31*b* is set to be about 2 cm and the interval between the oil collecting apertures 31*a* is set to about 3 cm.

The flow amount characteristics of the liquid refrigerant 11 and the refrigerant machine oil 12 flowing into the oil collecting pipe 31 can be adjusted by the arranging the intervals between the upper oil collecting apertures 31*b* to be narrower than the intervals between the lower oil collecting apertures 31*a* as described above. For example, when a large amount of the liquid refrigerant 11 remains, that is, when the height H of the liquid refrigerant 11 is high, there is a characteristic that a large amount of the refrigerant machine oil 12 will flow because the number of the oil collecting apertures 31*b* located in the layer of the refrigerant machine oil increases. Therefore, similar to the flow amount characteristics shown by the solid line of FIG. 12, the drop in the flow amount of the refrigeration machine oil in communication ports 31*c* and 28*a* can be reduced in the region where the liquid surface height H is high. As a result, a reduction of the amount of refrigerant machine oil 12 returned to the compressor can be prevented so that the reliability of the compressor can be enhanced.

Ninth Embodiment

The structure of an oil collecting pipe of an accumulator according to a ninth embodiment of the present invention will be described below. This embodiment is arranged to more promptly feed the refrigeration machine oil in the oil collecting pipe.

Figure 14A:
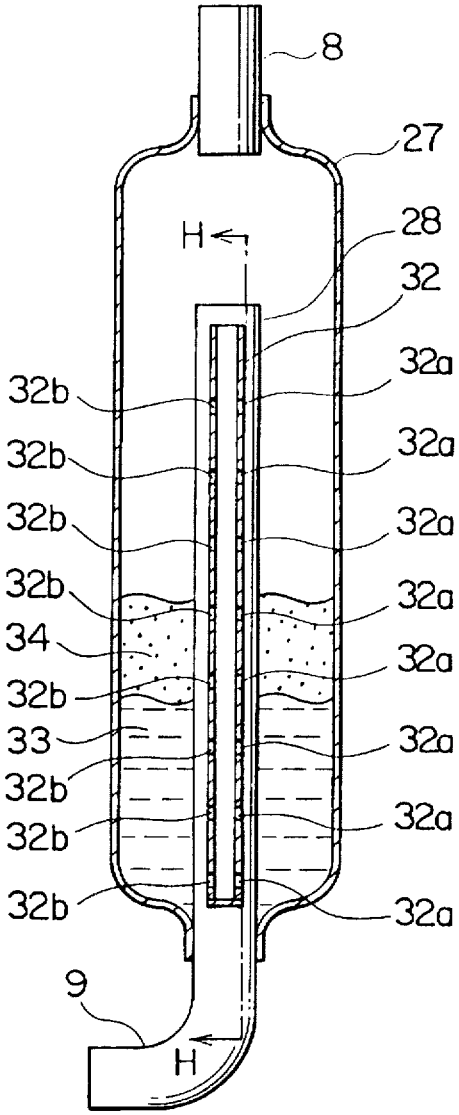
FIG. 14A is a longitudinal cross sectional view showing an accumulator according to a ninth embodiment of the present invention.
Figure 14B:
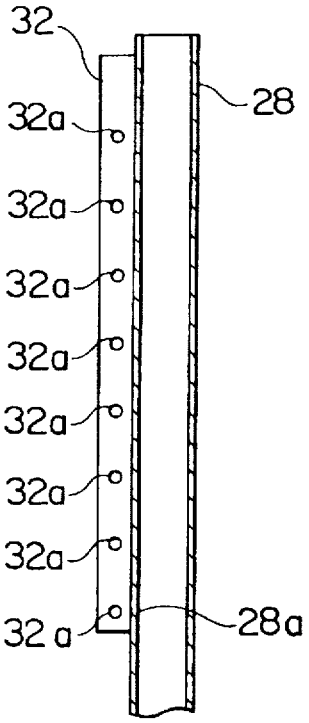
FIG. 14B is a cross sectional view taken along the line H—H of FIG. 14A.
Figure 14C:
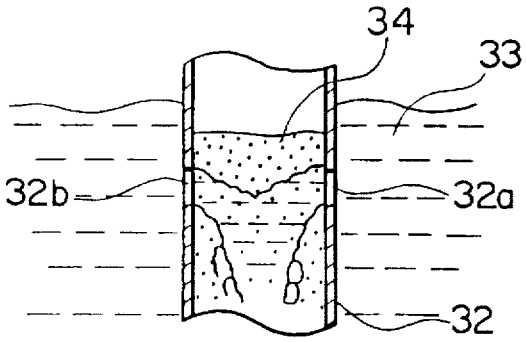
FIG. 14C is a view explaining the internal flow of liquid refrigerant and refrigeration machine oil of FIG. 14A.

FIG. 14A is a longitudinal cross sectional view showing an accumulator according to the ninth embodiment of the present invention. FIG. 14B is a cross sectional view taken along the line H—H of FIG. 14A. FIG. 14C is a view explaining the internal flow of liquid refrigerant and refrigeration machine oil of FIG. 14A.

In the drawings, an oil collecting pipe 32 is provided with the oil collecting apertures 32*a* and 32*b*. These apertures 32*a* and 32*b* are disposed opposite from each other on the same peripheries in a plurality of combinations. Liquid refrigerant 33 and refrigeration machine oil 34 remain in the sealed vessel 27.

The operation of the embodiment will be described. A plurality of oil collecting apertures 32*a* and 32*b*, two in this case, are disposed on opposite side of the same periphery of the oil collecting pipe 32. The liquid refrigerant 33 flows from the respective oil collecting apertures 32*a* and 32*b* collide as shown in FIG. 14C.

Since the collision is caused in the flow with in the oil collecting pipe 32, a turbid state is created in the liquid refrigerant 33 and the refrigeration machine oil 34 entering from the oil collecting apertures 32*a*, 32*b* to thereby accelerate the atomization of the refrigeration machine oil 34. Since the refrigeration machine oil 34 will easily flow downward together with the flow of liquid refrigerant 33, when it has a smaller particle size, the refrigeration machine oil can be fed easily so that the flow amount of the refrigeration machine oil 34 can be increased. As a result, reductions in the flow amount of the refrigeration machine oil 12 to be returned to the compressor can be prevented so that the reliability of the compressor can be enhanced.

Tenth Embodiment

The structure of an oil collecting pipe of an accumulator according to a tenth embodiment of the present invention will be described below. This embodiment is arranged to more promptly feed the refrigeration machine oil in the oil collecting pipe.

Figure 15A:
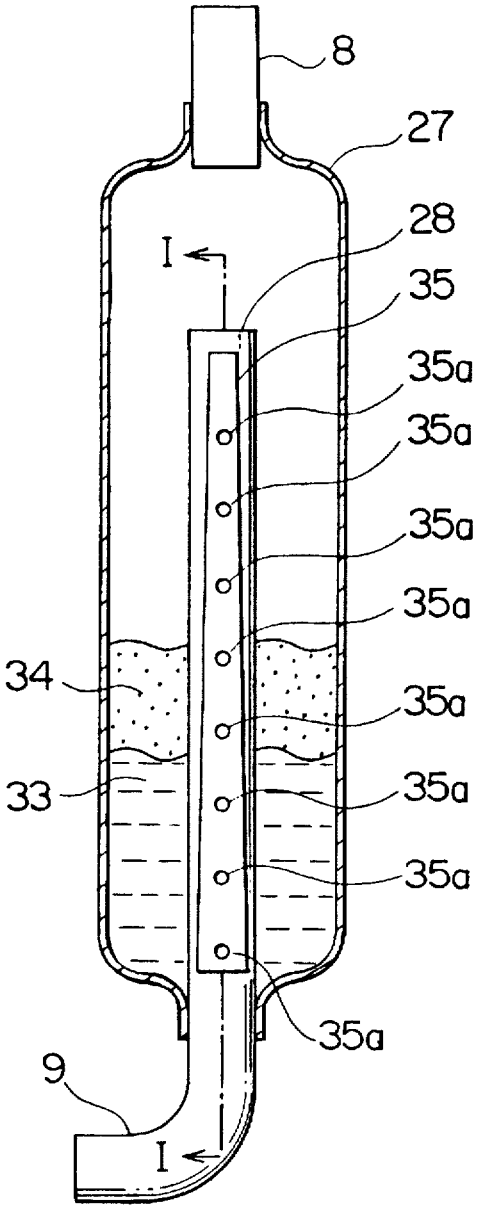
FIG. 15A is a longitudinal cross sectional view showing an accumulator according to a tenth embodiment of the present invention.
Figure 15B:
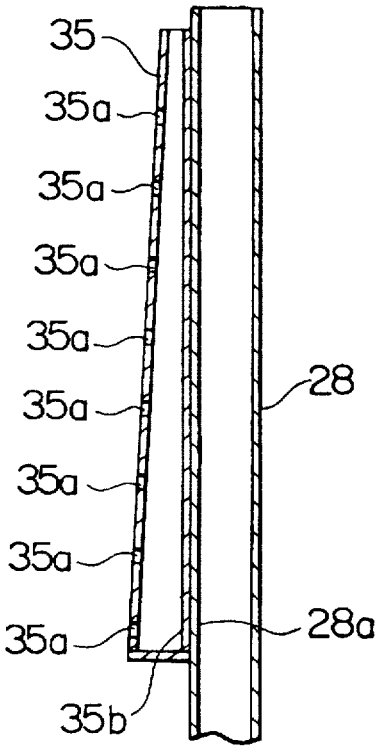
FIG. 15B is a cross sectional view taken along the line I—I of FIG. 15A.

FIG. 15A is a longitudinal cross sectional view showing an accumulator according to the tenth embodiment of the present invention. FIG. 15B is a cross sectional view taken along the line I—I of FIG. 15A.

In the drawings, an oil collecting pipe 35 has an upper cross sectional wall area larger than the lower cross sectional area. For example, the oil collecting pipe 35 is composed of a taper-shaped pipe whose inside diameter is about 5 mm at the upper end and about 10 mm at the lower end. A plurality of oil collecting apertures 35*a* are defined in the oil collecting pipe 35.

Next, the operation of the embodiment will be described. Although the refrigeration machine oil 34 flowing into the oil collecting pipe 35 flows together with the liquid refrigerant 33, generally speaking, as the flow velocity of the liquid refrigerant 33 in the pipe is higher than the oil, the droplets of the refrigeration machine oil 34 can be fed more easily. When the oil collecting pipe 35 is formed to have a uniform inside diameter as in the first embodiment, the flow amount of the liquid refrigerant in the oil collecting pipe 35 is greater in the lower portion of the pipe than in the upper portion thereof so that its flow velocity in the pipe is increased. However, since the pressure loss in the oil collecting pipe 35 is increased when the flow velocity of the liquid refrigerant in the pipe is high, the flow amount of the refrigeration machine oil 34 flowing from the upper oil collecting apertures is reduced by the pressure loss. Although a suitable pressure loss must be produced in the orifice-shaped communication ports 28*a*, 35*b* to control the total amount of the liquid refrigerant flowing to the discharge pipe 28, an excessive increase in pressure loss in the oil collecting pipe 35 must be prevented and the flow velocity in the lower portion of the oil collecting pipe 35 must be lowered.

In this embodiment, the change of the inflow velocity to the oil collecting pipe 35 can be reduced and the increase of the pressure loss in the pipe can be prevented by changing the inside diameter of the pipe in the vertical direction thereof in correspondence with the flow amount of the liquid refrigerant 33 in the pipe.

More specifically, for example, when the oil collecting pipe 35 is composed of a taper-shaped pipe having a diameter gradually increasing from the upper end to the lower end as shown in FIG. 15, the flow velocity at the lower portion of the oil collecting pipe 35 can be reduced. As a result, a drop in the flow amount of the refrigeration machine oil 34 flowing into the oil collecting pipe 35 can be prevented.

Note, since floating droplets cannot be fed if the flow velocity in the pipe is below a limit value, it is necessary to secure a certain flow velocity in the pipe, that is, an inside diameter of the pipe, which permits the droplets of the refrigeration machine oil 34 to be fed.

Eleventh Embodiment

The structure of an oil collecting pipe of an accumulator according to an eleventh embodiment of the present invention will be described below. This embodiment promptly feeds the refrigeration machine oil in the oil collecting pipe by a simple arrangement.

Figure 16A:
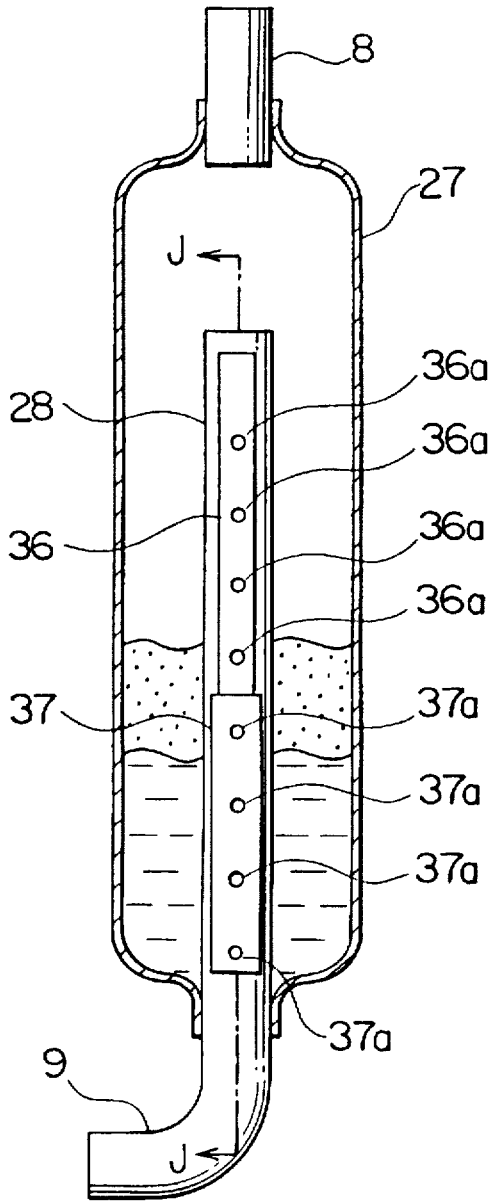
FIG. 16A is a longitudinal cross sectional view showing an accumulator according to an eleventh embodiment of the present invention.
Figure 16B:
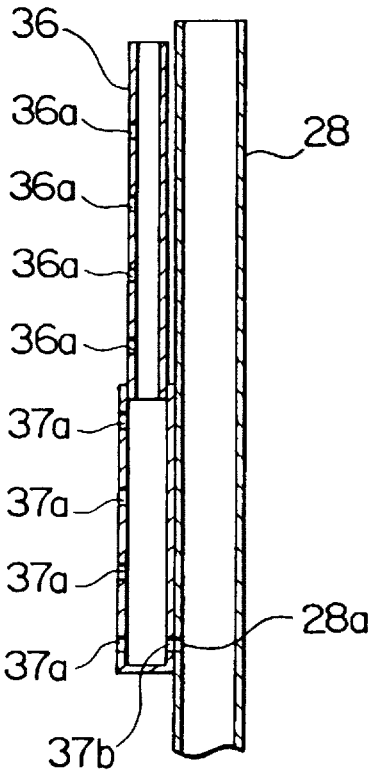
FIG. 16B is a cross sectional view taken along the line J—J of FIG. 16A.

FIG. 16A is a longitudinal cross sectional view showing an accumulator according to the eleventh embodiment of the present invention. FIG. 16B is a cross sectional view taken along the line J—J of FIG. 16A.

In the drawings, an oil collecting pipe 36 is connected to the upper portion of an oil collecting pipe 37. The oil collecting pipe 36 has a smaller inside diameter than that of the oil collecting pipe 37. That is, the oil collecting pipe is composed of, for example, pipes arranged in two stages so that the inside diameter of the lower pipe is larger than that of the upper pipe. A plurality of oil collecting apertures 36*a* and 37*a* are respectively defined in the oil collecting pipes 36 and 37.

Next, the operation will be described. The taper-shaped pipe such as the oil collecting pipe of the tenth embodiment presents some difficulties in machining. To cope with this problem, the oil collecting pipe of this embodiment is arranged by connecting pipes 36, 37 having different diameters as an example of a more simple structure.

In the oil collecting pipe 37 arranged as described, since the cross sectional area of the lower portion is larger than that of the upper portion, there is an advantage in that the flow velocity in the lower pipe is reduced to thereby decrease the pressure loss in the pipe. Therefore, this embodiment achieves an advantage similar to that of the tenth embodiment. As a result, a drop in the amount of refrigeration machine oil flowing into the oil collecting pipes 36, 37 can be prevented.

Twelfth Embodiment

The structure of an oil collecting pipe of an accumulator according to a twelfth embodiment of the present invention will be described below. This embodiment provides a plurality of oil collecting pipes and controls the flow amount of the liquid refrigerant by opening and closing a communication port with a float structure.

Figure 17:
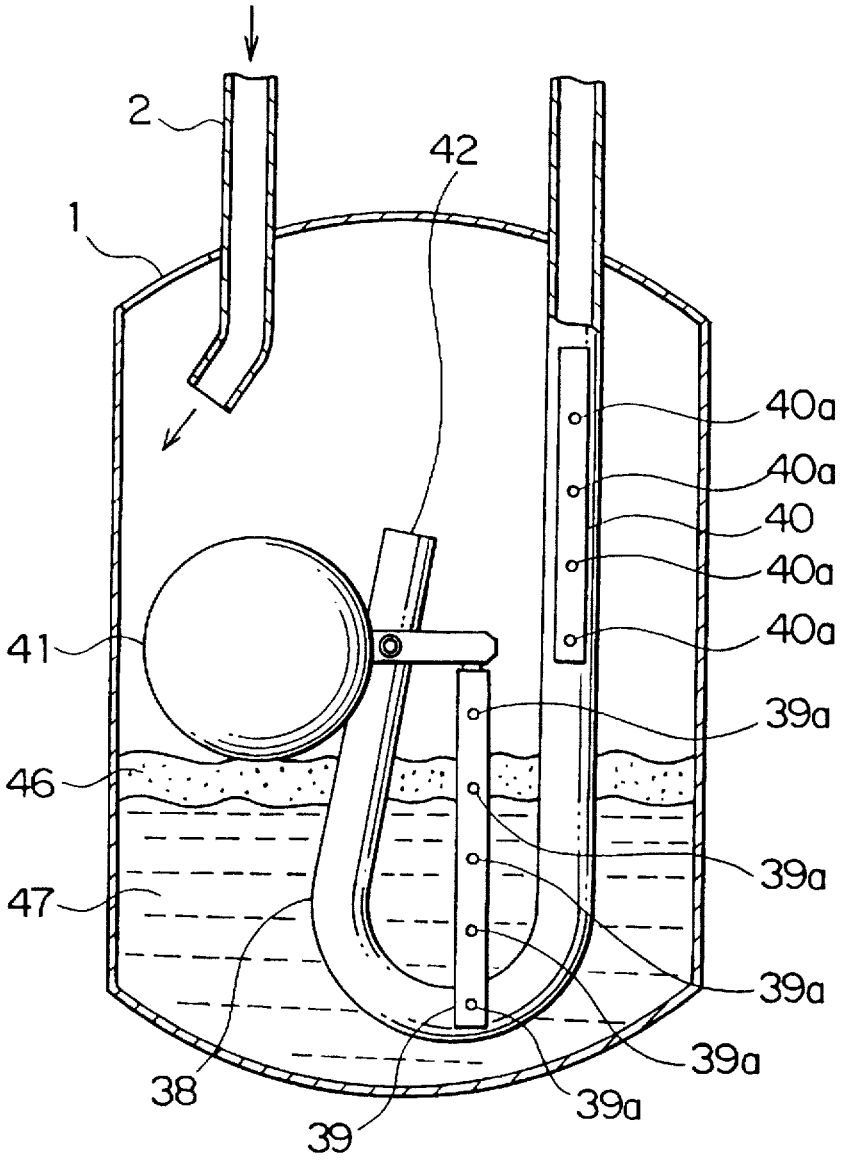
FIG. 17 is a longitudinal cross sectional view showing an accumulator according to a twelfth embodiment of the present invention.
Figure 18B:
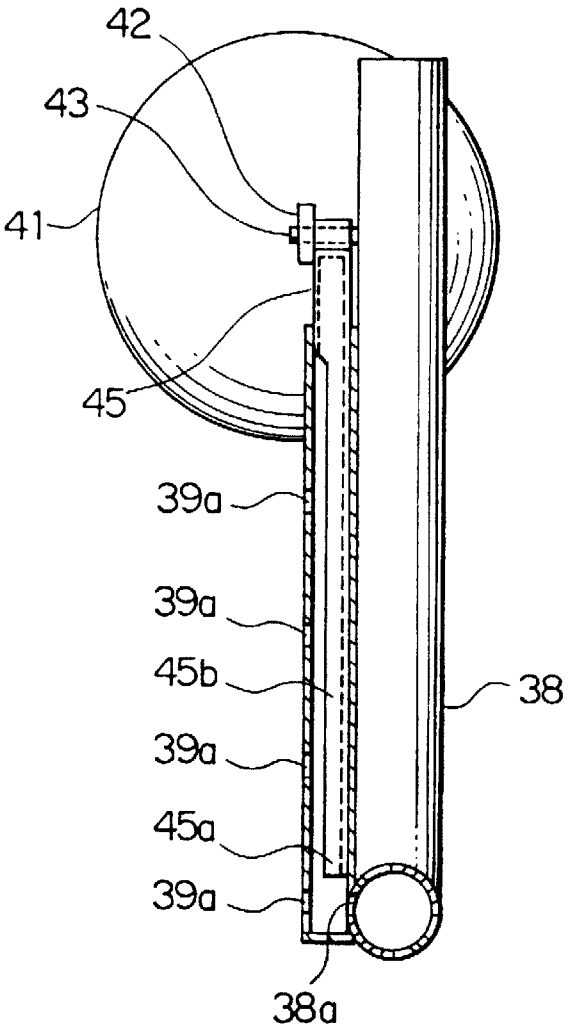
FIG. 18B is a cross sectional view taken along the line K—K of FIG. 18A.
Figure 18A:
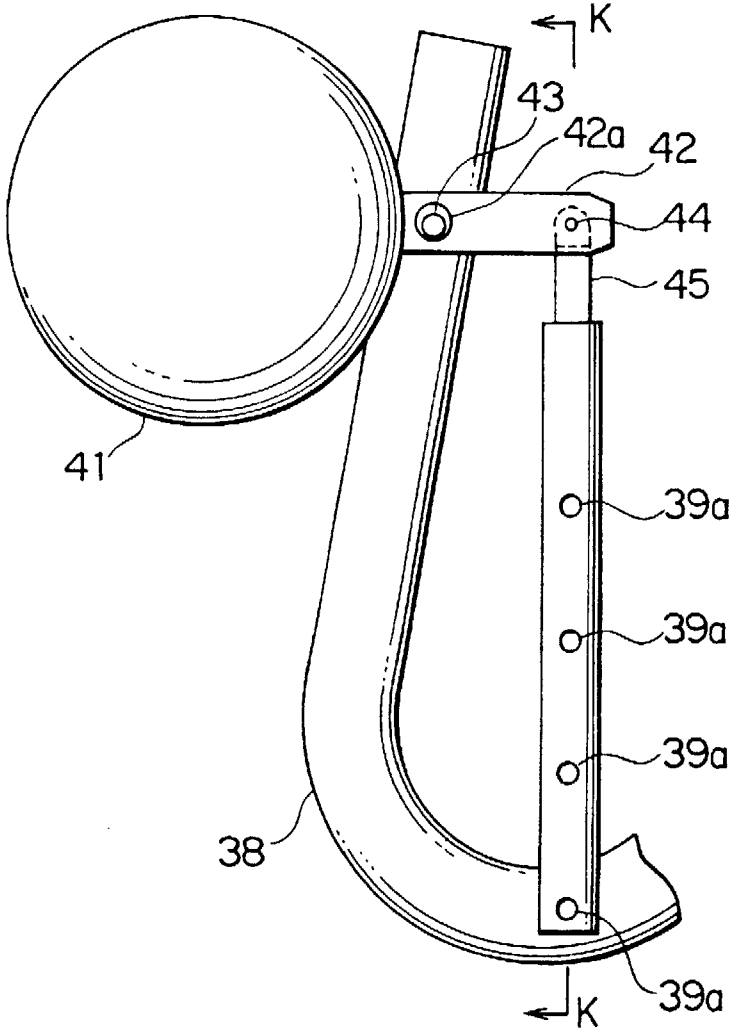
FIG. 18A is a view showing the arrangement of a main portion of the accumulator of FIG. 17.

FIG. 17 is a longitudinal cross sectional view showing an accumulator according to the twelfth embodiment of the present invention. FIG. 18A is a view showing the arrangement of a main portion of the accumulator of FIG. 17. FIG. 18B is a cross sectional view taken along the line K—K of FIG. 18A.

In the drawings, a discharge pipe 38 is provided with a communication port 38*a*. A first oil collecting pipe 39 has a plurality of oil collecting apertures 39*a*. A second oil collecting pipe 40 also has a plurality of oil collecting apertures 40*a*. A float 41 is disposed in the sealed vessel 1. Further, the float 41 moves upward and downward depending upon the height of the refrigeration machine oil 46 and the liquid refrigerant 47. A float arm 42 having a pin hole 42*a* is fixed to the float 41. A pin 43 is inserted into the pin hole 42*a* and serves as the fulcrum of the float arm 42. A pin 44 is disposed at the end of the float arm 42. A communication port opening/closing rod 45 is coupled with the pin 44 and executes an upward/downward motion in association with the motion of the float arm 42. A communication port opening/closing unit 45*a* is located in lower portion of the communication port opening/closing rod 45 and has a function as an opening/closing mechanism. A recess 45*b* is formed in the communication port opening/closing rod 45 to remove the portions in contact with the oil collecting apertures 39*a* to prevent the clogging thereof. The refrigeration machine oil 46 floats on the liquid refrigerant 47.

The first oil collecting pipe 39 and the second oil collecting pipe 40 are held at a different height and the upper end of the oil collecting pipe 39 held at a lower portion is closed. Further, the first oil collecting pipe 39 communicates with the discharge pipe 38 at the lower end thereof through the communication port 38*a* and the second oil collecting pipe 40 communicates with the discharge pipe 38 at the lower end thereof through a communication port (not shown) likewise. The communication port opening/closing unit 45*a* constituting the opening/closing mechanism and the float 41 constituting a control mechanism for actuating the opening/closing mechanism in accordance with the liquid surface height are mounted on the first oil collecting pipe 39 to open/close the flow passage of refrigerant flowing in the first oil collecting pipe 39.

Figure 19B:
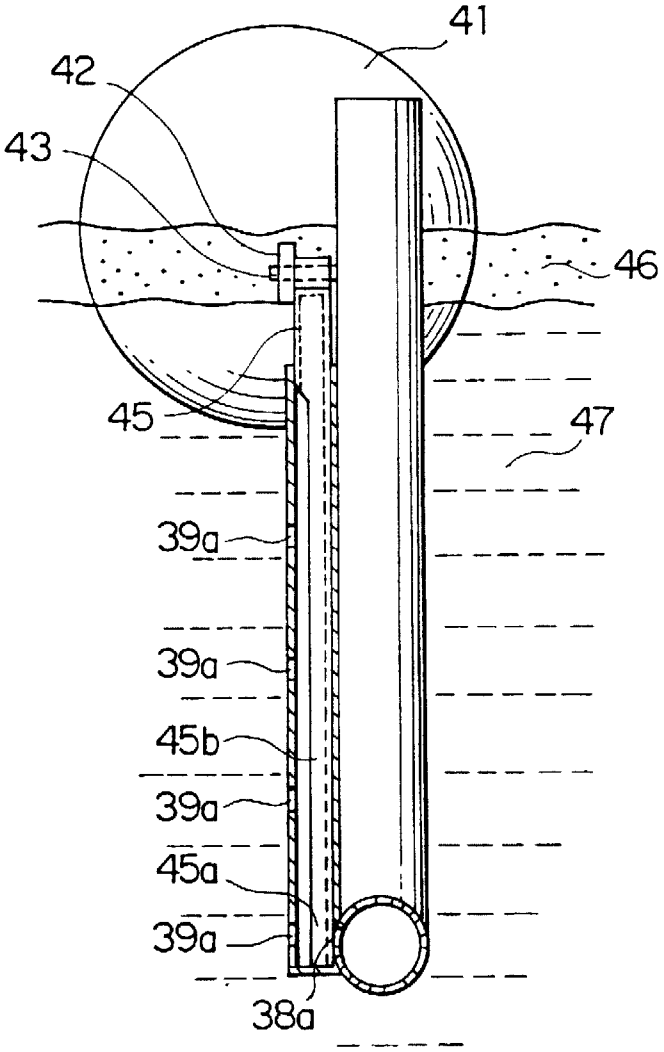
FIG. 19B is a view explaining the operation of the accumulator according to the twelfth embodiment.
Figure 19A:
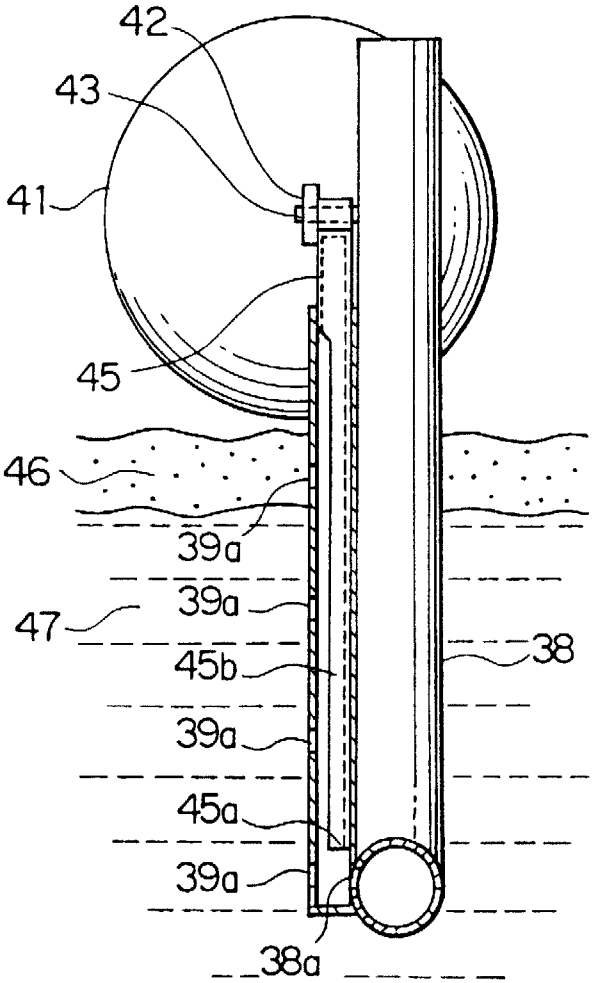
FIG. 19A is a view explaining the operation of the accumulator according to the twelfth embodiment.

The operation of this embodiment will be described. FIG. 19A shows a case that the refrigeration machine oil 46 and the liquid refrigerant 47 have a low liquid surface level, whereas FIG. 19B shows a case that they have a high liquid surface level. In FIG. 19A, the float 41 falls and the communication port opening/closing rod 45 coupled with it rises so that the communication port 38*a* is opened. On the other hand, in FIG. 19B, the float 41 rises by floating on the refrigeration machine oil 46 and the communication port opening/closing rod 45 coupled with it falls so that the communication port 38*a* is closed.

Figure 20:
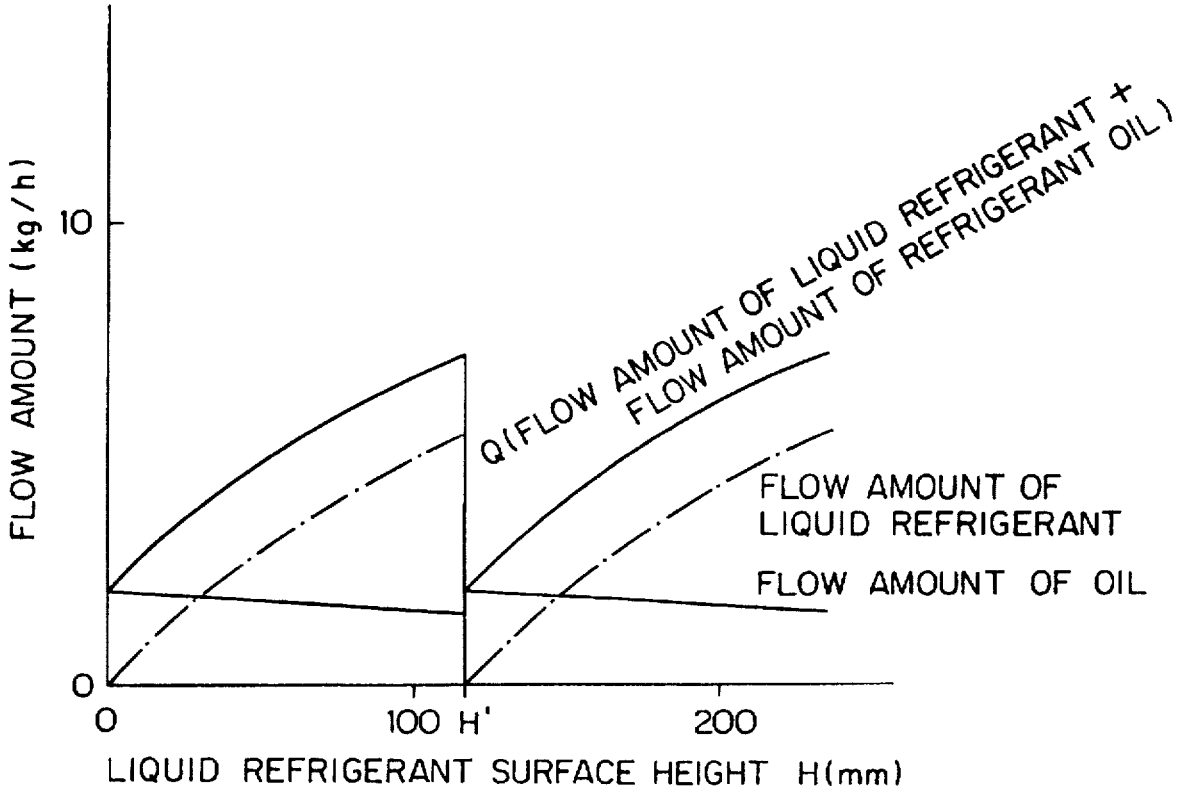
FIG. 20 is a characteristic graph showing the relationship between the flow amounts (kg/h) of liquid refrigerant and refrigeration machine oil and a liquid refrigerant surface height (mm) according to the twelfth embodiment.

The amount of the liquid refrigerant 47 flowing into the discharge pipe 38 is changed by the opening and closing of the communication port 38*a*. FIG. 20 shows the flow amount characteristics when the height of the liquid refrigerant 47 changes. In the drawing, the abscissa represents the height H (mm) of the liquid refrigerant surface, the ordinate represents the amount (kg/h) of the fluid flowing from the oil collecting pipes 39, 40 through the communication port 38*a* and H' denotes the height of the lowermost oil collecting aperture 40*a* defined in the second oil collecting pipe 40.

When the height H of the liquid refrigerant 47 is below H', the liquid refrigerant 47 flows into the discharge pipe 38 through the communication port 38*a* as in the first embodiment. As the height H of the liquid refrigerant increases, the number of the oil collecting apertures in the liquid increases so that the flow amount of the liquid refrigerant increases. When the height H of the liquid refrigerant 47 reaches H', the communication port 38*a* is closed. As a result, the flow amount of the liquid refrigerant 47 becomes 0 as shown in the drawing. On the other hand, the refrigeration machine oil 46 flows into the discharge pipe 38 from the oil collecting aperture 40*a* of the second oil collecting pipe 40 at the time it reaches the liquid surface height H of the liquid refrigerant 47. Thus, the characteristic as shown in the drawing is obtained.

Since the communication port 38*a* is closed when the height H of the liquid refrigerant 47 rises and H'<H is established, the liquid refrigerant 47 flows only from the second oil collecting pipe 40. Therefore, the flow amount of the liquid refrigerant 47 increases as the height H of the liquid refrigerant 47 increases. The flow amount of the refrigeration machine oil 46 gradually decreases as the height H of the liquid refrigerant 47 increases.

That is, since the flow of the liquid refrigerant into the discharge pipe 38 is suppressed when the height H of the liquid refrigerant 47 is high, the reliability of the compressor is improved.

Note, the number of the oil collecting pipes is not limited to two. When three or more are provided, the amount of the liquid refrigerant flowing into the discharge pipe 38 can be more minutely controlled. Further, although the communication port 38*a* is closed by the rod 45 connected to the float 41 in the above arrangement, the oil collecting aperture 39*a* may be closed.

Thirteenth Embodiment

The structure of an oil collecting pipe of an accumulator according to a thirteenth embodiment of the present invention will be described below. The accumulator of this embodiment is arranged to collect the refrigeration machine oil by providing a plurality of oil collecting pipes having different lengths and a pipe for gathering the respective pipes.

Figure 21A:
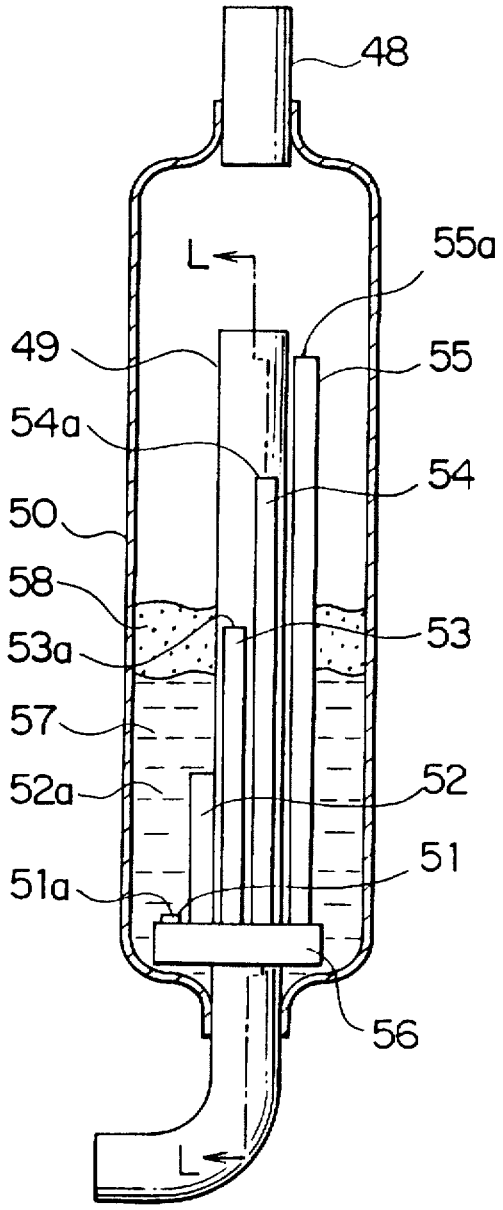
FIG. 21A is a longitudinal cross sectional view showing an accumulator according to a thirteenth embodiment of the present invention.
Figure 21B:
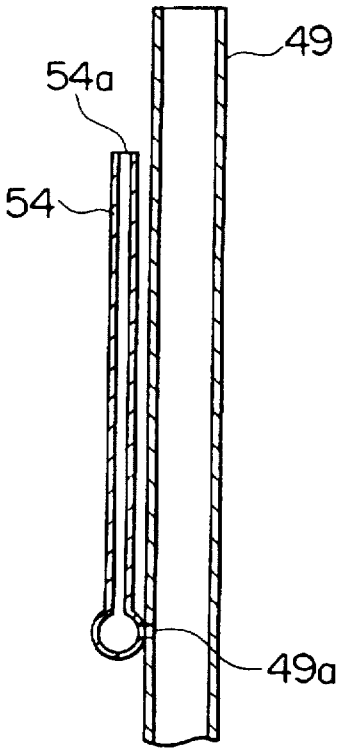
FIG. 21B is a cross sectional view taken along the line L—L of FIG. 21A.
Figure 22:
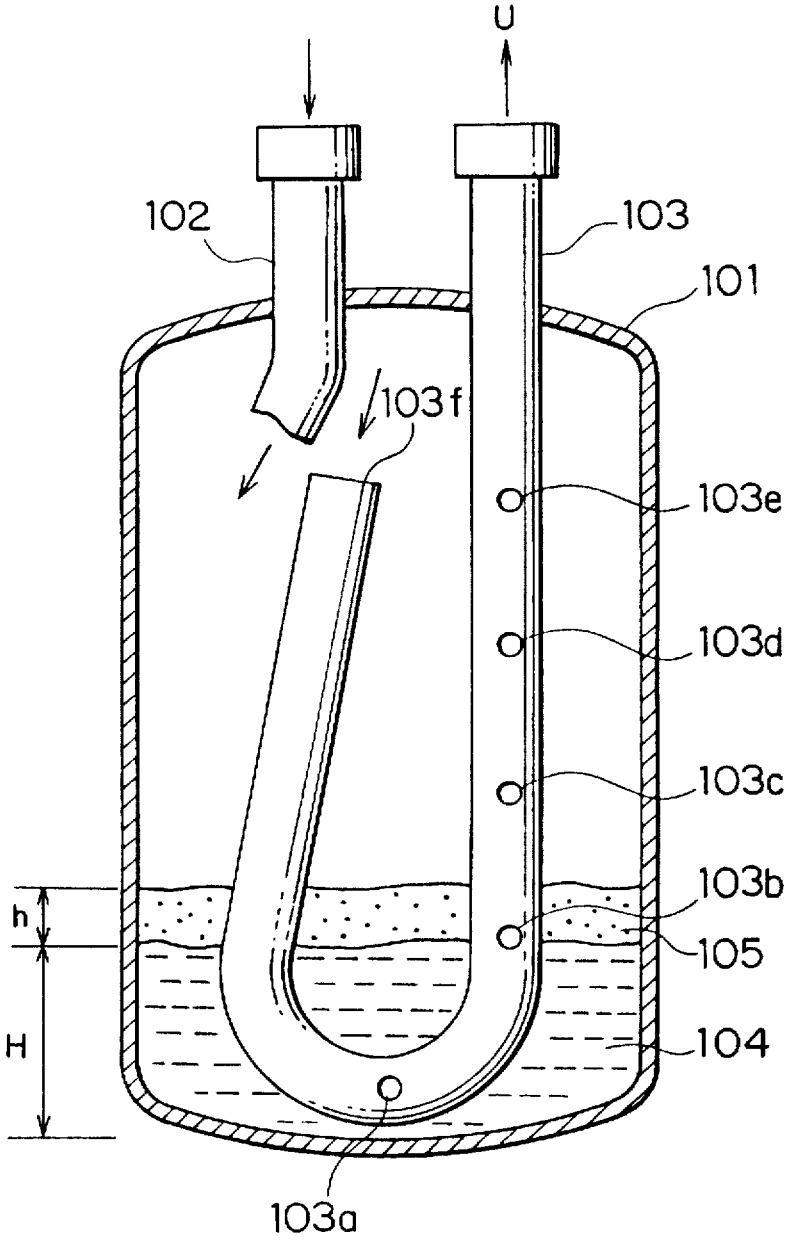
FIG. 22 PRIOR ART
FIG. 22 is a longitudinal cross sectional view showing an example of a conventional accumulator.
Figure 23:
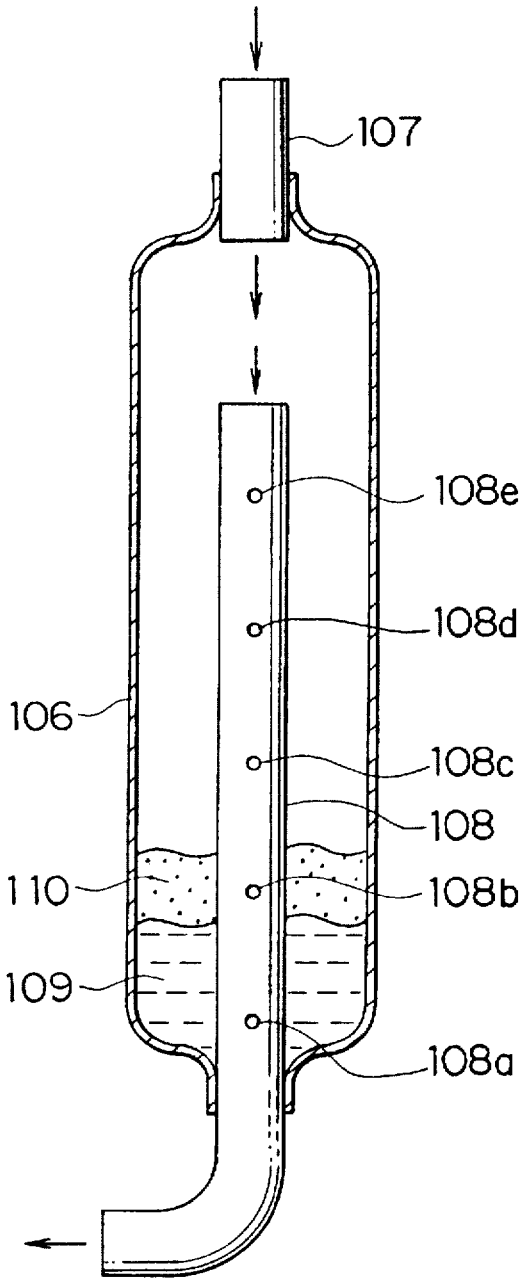
FIG. 23 PRIOR ART
FIG. 23 is a longitudinal cross sectional view showing another example of the conventional accumulator.

FIG. 21A is a longitudinal cross sectional view showing an accumulator of this embodiment. FIG. 21B is a cross sectional view taken along the line L—L of FIG. 21A.

In the drawings, a suction pipe 48 is connected to the upper portion of a sealed vessel 50. A discharge pipe 49 having a communication port 49*a* is inserted into the sealed vessel 50. Five oil collecting pipes 51–55 having different lengths are disposed in the sealed vessel 50. The oil collecting pipes 51–55 have open portions 51*a*–55*a* at their upper ends. Further, the lower ends of the oil collecting pipes 51–55 are gathered into the gathering pipe 56 which communicates with the communication port 49*a*. Liquid refrigerant 57 resides in the sealed vessel 50. Refrigeration machine oil 58 floats on the upper layer of the liquid refrigerant 57.

Next, the operation of the embodiment will be described. The height of the liquid refrigerant 57 is determined by the amount there of in the accumulator and the amount of the liquid refrigerant 57 in the accumulator is determined by the operating conditions of the refrigerating/air conditioning circuit. Usually, since the operating conditions cover a wide range of pressure and temperature conditions, the height of the liquid refrigerant 57 is not fixed. Therefore, the height of the refrigerant machine oil 58 floating on the upper layer of the liquid refrigerant 57 is not also fixed. Even in such a case, since the lengths of the oil collecting pipes 51–55 are formed stepwise, the refrigerant machine oil 58 may be sucked from any of the oil collecting pipes.

That is, as shown in the drawing, when the refrigerant machine oil 58 is in the vicinity of the upper end of the oil collecting pipe 53, the refrigerant machine oil 58 flows into the oil collecting pipe 53 from the open end 53*a* thereof. Further, the liquid refrigerant 57 also flows into the oil collecting pipes 51, 52 from the open ends 51*a*, 52*a* thereof. The refrigerant machine oil 58 and the liquid refrigerant 57 flowing into the oil collecting pipes also flows into the gathering pipe 56 with a pressure loss generated in the communication port 49*a* similar to the first embodiment. The flow amount of the liquid refrigerant is therefore controlled so that it is not excessively sucked into the discharge pipe 49.

As described above, since a plurality of oil collecting pipes each having a different length are provided and the fluid flowing into the oil collecting pipes is permitted to flow into the discharge pipe from the one communication port, even if the surface of the refrigeration machine oil is indefinite, the flow amount of the refrigeration machine oil can be secured so that the refrigeration machine oil can be collected from the accumulator into the compressor. As a result, reductions in the oil in the compressor can be prevented and the reliability the compressor can be secured.

What is claimed is:

1. An accumulator, comprising:

a sealed vessel for temporarily storing refrigerant circulating in a refrigerating/air conditioning circuit;

a suction pipe for introducing the refrigerant into said sealed vessel;

a discharge pipe for discharging the refrigerant in said sealed vessel; and an oil collecting pipe held in said sealed vessel with the lower end thereof closed and having a plurality of oil collecting apertures spaced in a vertical direction and a communication port for communicating with said discharge pipe, said communication port being disposed in the vicinity of the lowermost oil collecting aperture of said oil collecting pipe or to the downstream side of the aperture.

2. An accumulator according to claim 1, comprising:

a columnar member held in said oil collecting pipe to thereby form a space serving as the flow passage of the refrigeration machine oil mixed with the refrigerant between the inner wall of said oil collecting pipe and the side surface of said columnar member.

3. An accumulator according to claim 1 wherein said oil collecting pipe is arranged to surround said discharge pipe and a space serving as the flow passage of the refrigeration machine oil mixed with the refrigerant is formed between the inner wall of said oil collecting pipe and the side surface of said discharge pipe.

4. An accumulator according to claim 1 wherein said oil collecting apertures are formed to have at least two different sizes and the larger oil collecting apertures are disposed above the smaller oil collecting apertures.

5. An accumulator according to claim 1 wherein the intervals between adjacent oil collecting apertures are of at least two lengths and the oil collecting apertures with a narrower interval are disposed above the oil collecting apertures with a wider interval.

6. An accumulator according to claim 1 wherein a plurality of oil collecting apertures among said oil collecting pipes are disposed along the same periphery of said oil collecting pipe.

7. An accumulator according to claim 1 wherein the cross sectional area of the upper portion of said oil collecting pipe is made smaller than that of the lower portion thereof.

8. An accumulator, comprising:

a sealed vessel for temporarily storing refrigerant circulating in a refrigerating/air conditioning circuit;

a suction pipe for introducing the refrigerant into said sealed vessel;

a discharge pipe for discharging the refrigerant in the sealed vessel;

a plurality of oil collecting pipes each held at a different height in said sealed vessel and having a plurality of oil collecting apertures spaced in a vertical direction and a communication port for communicating with said discharge pipe, said communication port being disposed in the vicinity of the lowermost oil collecting aperture of each of said oil collecting pipes or to the downstream side of the aperture;

an opening/closing mechanism for opening and closing refrigerant passages passing through the plurality of oil collecting pipes except for the uppermost refrigerant passage; and a control mechanism for actuating said opening/closing mechanism according to the liquid surface height in said sealed vessel;

wherein the refrigerant passages are arranged in such a manner that the upper ends of said oil collecting pipes except for the uppermost pipe are closed, said opening/closing mechanism is actuated by said control mechanism in accordance with the liquid surface height in said sealed vessel and said oil collecting pipes in operation among said plurality of oil collecting pipes are switched.

9. An accumulator according to claim 8, comprising:

a columnar member held in said oil collecting pipe to thereby form a space serving as the flow passage of the refrigeration machine oil mixed with the refrigerant between the inner wall of said oil collecting pipe and the side surface of said columnar member.

10. An accumulator according to claim 8 wherein said oil collecting pipe is arranged to surround said discharge pipe and a space serving as the flow passage of the refrigeration machine oil mixed with the refrigerant is formed between the inner wall of said oil collecting pipe and the side surface of said discharge pipe.

11. An accumulator according to claim 8 wherein said oil collecting apertures are formed to have at least two different sizes and the larger oil collecting apertures are disposed above the smaller oil collecting apertures.

12. An accumulator according to claim 8 wherein the intervals between adjacent oil collecting apertures are of at least two lengths and the oil collecting apertures with a narrower interval are disposed above the oil collecting apertures with a wider interval.

13. An accumulator according to claim 8 wherein a plurality of oil collecting apertures among said oil collecting pipes are disposed along the same periphery of said oil collecting pipe.

14. An accumulator according to claim 8 wherein the cross sectional area of the upper portion of said oil collecting pipe is made smaller than that of the lower portion thereof.

15. An accumulator, comprising:

a sealed vessel for temporarily storing refrigerant circulating in a refrigerating/air conditioning circuit;

a suction pipe for introducing the refrigerant into said sealed vessel;

a discharge pipe for discharging the refrigerant in the sealed vessel;

a plurality of oil collecting pipes held in said sealed vessel with the upper ends thereof opened and having a different length; and a gathering pipe connected to each of said oil collecting pipes at a position below the upper end thereof and having a communication port for communicating with said discharge pipe.

* * * * *